US006005338A

United States Patent [19]

Omae et al.

[11] Patent Number: 6,005,338

[45] Date of Patent: Dec. 21, 1999

[54] CATHODE-RAY TUBE AND PROCESS FOR PRODUCING THE SAME

[75] Inventors: Hideharu Omae, Toyonaka; Masahiko Konda, Ibaraki; Kazuaki Hirabayashi, Takatsuki; Mitsuhiro Otani, Sakai; Shigeo Nakatera, Hirakata, all of Japan

[73] Assignees: Matsushita Electronics Corporation; Matsushita Electric Industrial Co., Ltd., both of Osaka, Japan

[21] Appl. No.: 08/973,448

[22] PCT Filed: Apr. 17, 1997

[86] PCT No.: PCT/JP97/01342

§ 371 Date: Feb. 6, 1998

§ 102(e) Date: Feb. 6, 1998

[87] PCT Pub. No.: WO97/39471

PCT Pub. Date: Oct. 23, 1997

[30] Foreign Application Priority Data

Apr. 18, 1996 [JP] Japan ..... 8-097190

[51] Int. Cl.[6] ..... H01J 9/14; H01J 29/48; H01J 29/58

[52] U.S. Cl. ..... 313/412; 313/414; 313/450; 445/34; 445/36

[58] Field of Search ..... 313/412, 414, 313/450; 445/34, 36

[56] References Cited

U.S. PATENT DOCUMENTS 4,713,879 12/1987 Vrijssen ..... 445/36
5,489,229 2/1996 Muti et al. ..... 445/34
5,521,464 5/1996 Vrijssen et al. ..... 313/450

FOREIGN PATENT DOCUMENTS 1-22504 9/1989 Japan .
4-23402 4/1992 Japan .
5-258683 10/1993 Japan .
6-275211 9/1994 Japan .

*Primary Examiner*—Ashok Patel
*Attorney, Agent, or Firm*—Akin, Gump, Strauss, Hauer & Feld, L.L.P.

[57] ABSTRACT

In order to provide a method of producing a cathode ray tube in a manner which well matches with a usual technique of producing a cathode ray tube by forming a spiral high-resistor on an inner face of a glass tube, in an electron gun of which a main focusing lens is configured by the spiral high-resistor, the step of fritting seal rings to both ends of the glass tube in which a hole is opened in the center portion; the step of applying a high-resistor paste to the glass tube, drying the paste, and then forming a spiral structure in the high-resistor film; the step of firing at 420 to 550 deg. C.; and the step of combining other electron gun parts to form the electron gun are included, and the spiral high-resistor is formed by a high-resistor paste in which ruthenium oxide is added to a glass material having a softening point that is lower than the annealing point of the glass tube.

38 Claims, 11 Drawing Sheets

(a)

(b)

(a)

(b)

CATHODE-RAY TUBE AND PROCESS FOR PRODUCING THE SAME

TECHNICAL FIELD

The invention relates to a cathode ray tube for projection type and direct viewing type in which a spiral high-resistor is used as a main focusing lens, and also to a method of producing it.

BACKGROUND OF THE INVENTION

It is known that an electron gun in which a main focusing lens is configured by a spiral high-resistor can attain high resolution in a cathode ray tube produced by using the same.

As a method of producing such a main focusing lens of an electron gun for a cathode ray tube, as shown in Japanese patent publication (Kokai) No. HEI6-275211, there is a method using a paste containing ruthenium oxide ($RuO_2$) and glass. In this method, a resistance material consisting of the ruthenium oxide and a glass paste is formed into a spiral shape on the inner face of a cylindrical tube of insulative ceramics or the like. In another method, after a resistance material consisting of the ruthenium oxide and the glass paste was uniformly applied to the inner face of a cylindrical tube, it is formed into a spiral resistor member by trimming method or other method. Thereafter, firing is conducted at 850 deg. C. for 10 minutes, with the result that a spiral high-resistor having a resistance of 100 MΩ to 10 TΩ is obtained. In order to electrically connect the thus formed main focusing lens to other electrode, a cylindrical holder made of a metal such as stainless steel is fitted into the inner face of an end portion of the cylindrical tube. In the cylindrical holder, pairs of projections which are opposed to each other are disposed in three portions. Among the projections, inner ones are contacted with the spiral high-resistor formed on the inner face of the cylindrical tube.

Another method of producing a main focusing lens is disclosed in Japanese patent (Kokoku) No. HEI4-23402. In the method, a resistor layer is formed on the inner face of a hollow tube which is made of glass and to which a metal part is welded, by applying a suspension containing ruthenium hydroxide ($Ru(OH)_3$) and glass particles and then drying it. Thereafter, the resistor layer on the inner face of the hollow tube is machined into a spiral shape, and then heated to 400 to 600 deg. C., so that ruthenium hydroxide is changed to ruthenium oxide, and a spiral resistor of a composition in which ruthenium oxide fuses with glass particles in the resistor layer is obtained.

However, the above-mentioned methods of the prior arts have several problems in formation of a spiral high-resistor having uniform properties.

First, the resistance material used in the method disclosed in the Japanese patent publication (Kokai) No. HEI6-275211 is a thick-film resistor material for a chip resistor which is conventionally used in an electronic circuit board or the like. Therefore, the firing temperature is considerably high or 850 deg. C., and a glass tube or a ceramic tube which can withstand the temperature must be used. Although a kind of such a glass tube is a quartz glass tube, a quartz glass tube has a very small coefficient of thermal expansion as described later, thereby producing a problem in connection with other member having a large coefficient of thermal expansion. In the case where a ceramic tube is used, since a molding accuracy is inferior to that of a glass tube, a working process must be done during or after a process of molding the ceramic tube in order to improve the accuracy, resulting in a high cost.

Specifically, in the method disclosed in the Japanese patent (Kokoku) No. HEI6-275211, ruthenium oxide is used as the high resistance material. Since the firing temperature is 850 deg. C., quartz glass is used; but the quartz glass is expensive. The coefficient of thermal expansion is $5.5\times10^{-7}$/deg. C. and very smaller in comparison with the coefficient of thermal expansion of usual glass for the cathode ray tube. By contrast, in the case where the ceramic tube is used, since the surface roughness is so large as 1 to 2 μm, it is difficult to form a spiral with high accuracy on the inner face of the ceramic tube. When the surface of the ceramic tube is smoothed by cutting the inner surface, it becomes very expensive. Furthermore, since a metal part cannot be welded to the ceramic tube with frit glass, in order to bond the metal part such as a metal electrode to the ceramic tube, a special working process is required.

In the method disclosed in HEI4-23402 in which ruthenium hydroxide is used, the suspension has a low viscosity and hence it is difficult to form a layer of such a thickness as larger than about 1 to 1.5 μm and uniform. Furthermore, glass flows during the process of thermally decomposing ruthenium hydroxide, which is an insulator, by heating (400 to 600 deg. C.) to deposit ruthenium oxide which is a conductor. At this time, very fine ruthenium oxide particles of 0.01 to 0.03 μm are deposited around glass particles so as to form a resistor. In such a case, when a high resistance of, for example, 20 GΩ is to be obtained, the firing temperature dependency becomes large. In other words, there was a problem in that even a small variation of the firing temperature caused the resistance to be largely changed.

Furthermore, when the metal part is welded to the hollow glass tube at a high temperature of 800 deg. C. or higher, an oxide film is formed on the surface of the metal part and charges are generated in the surface. Therefore, the electric field of the main focusing lens becomes unstable. The inventor has found a problem of generation of such phenomenon that the charges cause spot shape to swingingly deform and impair the resolution of the display screen in operation of the cathode ray tube.

Moreover, there is a possibility that the oxide film impairs the connection state between the metal part and the resistor member.

In the connection part of the metal part and the hollow glass tube, moreover, molten glass may rise up to form an annular projection. When the annular projection is formed, the thickness of a resistor applied to the portion is reduced hence inducing a possibility of conduction failure.

The invention purposes to provide a high-resolution cathode ray tube having a main focusing lens using a spiral which solves the above-discussed problems and has a stable resistance, and a method of economically producing it.

To comply with this, materials of parts are selected so that a firing process can be conducted at about 450 deg. C. of a firing temperature in production of the cathode ray tube of the prior art.

It is an object to prevent variation of the spot shape from occurring by avoiding formation of oxide film on the surface of a metal part or by removing the formed oxide film, thereby improving the resolution.

BRIEF SUMMARY OF THE INVENTION

According to the invention, the method for producing a cathode ray tube having a spiral, which is formed on an inner face of a glass tube and functions as a main focusing lens for an electron gun, comprises the steps of:

applying a high-resistor paste on the inner face of the above-mentioned glass tube, thereby forming a high-resistor film;

forming a spiral groove in the above-mentioned high-resistor film; and firing the high-resistor film having the above-mentioned spiral groove at a temperature of 440 to 460 deg. C. to obtain a spiral high-resistor.

As the high-resistor paste, high-resistor with a resistance not lower than 0.8 GΩ and not higher than 100 GΩ after firing in the above-mentioned temperature range is used.

According to the above-mentioned structure and production method, it is not required to use a ceramic tube which has high heat resistance as a cylindrical tube for a main focusing lens.

The high-resistor paste for forming the above-mentioned spiral high-resistor has a feature that a high-resistor material in which ruthenium oxide is added to glass powder having a softening point that is lower than the annealing point of the glass tube is used. Because of this feature, distortion of the glass tube can be eliminated.

Preferably, the glass tube, frit material, a seal ring, and the high-resistor material which constitute the above-mentioned electron gun for the above-mentioned cathode ray tube have a coefficient of thermal expansion in the range of 85 to $105\times10^{-7}$/deg. C. According to this, it is possible to prevent a crack and separation in the high-resistor film due to the heat treatment. It is also possible to prevent the seal ring from being separated from the glass tube.

The resistance of the above-mentioned spiral high-resistor is selected in the following manner. Namely, the resistance is set so that, when a difference voltage between the anode voltage and the focus voltage of the cathode ray tube is applied to the spiral high-resistor, the current flowing through the above-mentioned spiral high-resistor is in the range of 0.25 $\mu$A to 30 $\mu$A. As a result of this setting, a potential distribution which is necessary and preferable can be obtained and variation of the focus voltage is prevented from occurring.

In another aspect of the invention, the method of producing a cathode ray tube has a main focusing lens, in which a high-resistor of a high-resistance material having a thermal expansion coefficient of 36 to $105\times10^{-7}$/deg. C. is formed into a spiral shape on an inner face of a glass tube of borosilicate glass or soda glass material having a thermal expansion coefficient of 36 to $105\times10^{-7}$/deg. C. and a volume resistance of $1\times10^{10}$ to $1\times10^{12}$ ohm·cm, and comprises the steps of:

disposing seal rings being metal parts which are used for electrical connection with other electrode parts to both ends of the above-mentioned glass tube;

applying a high-resistor paste to the above-mentioned glass tube, thereby forming a high-resistor film;

forming the above-mentioned high-resistor film into a spiral structure;

firing the above-mentioned glass tube at 420 to 550 deg. C.; and combining other electrode parts with the above-mentioned glass tube to form an electron gun.

A preferred species of the above-mentioned production method further comprises a step of disposing a focusing voltage supply portion in the vicinity of the center of the glass tube.

More preferably, the above-mentioned high-resistor paste is a high-resistor material in which ruthenium oxide is added to a glass material having a softening point that is lower than the annealing point of the above-mentioned glass tube.

The glass material contains 25 to 40 wt. % of a filler made of a material of at least one of $ZrO_2$, $SiO_2$, and $Al_2O_3$.

In a species of the method of producing the above-mentioned cathode ray tube, it is characterized in that the resistance is set so that, when a difference voltage between the anode voltage and the focus voltage is applied to the above-mentioned spiral high-resistor, the current flowing through the spiral high-resistor is in the range of 0.25 $\mu$A to 30 $\mu$A.

In a further preferred species of the method of producing the above-mentioned cathode ray tube, the method further comprises a step of, in order to bond a metal part for applying a predetermined potential to the spiral high-resistor to the glass tube, welding the metal part to the above-mentioned glass tube by using a frit, and it is characterized in that the above-mentioned glass tube, the above-mentioned frit, the above-mentioned metal part, and the above-mentioned material of the spiral high-resistor have a thermal expansion coefficient in the range of 36 to $105\times10^{-7}$/deg. C. According to these matters, it is possible to prevent a crack and separation due to the heat treatment from occurring.

Furthermore, the method of producing the above-mentioned cathode ray tube is characterized in that it further comprises the step of, in order to bond a metal part for applying a predetermined potential to the above-mentioned spiral high-resistor to the above-mentioned glass tube, welding the glass tube to the metal part by melting a frit or the glass tube itself in a reducing gas atmosphere or an inert gas atmosphere. According to this configuration, the metal part is prevented from being oxidized.

Furthermore, in the method of producing the above-mentioned cathode ray tube, in the step of, in order to bond a metal part for applying a predetermined potential to the above-mentioned spiral high-resistor to the above-mentioned glass tube, welding it to the above-mentioned metal part by melting a frit or the glass tube itself, it is characterized in that the above-mentioned metal part has a film for preventing oxidation.

It is characterized in that the film for preventing oxidation is a film which is formed by one of deposition of gold, gold plating, and nickel plating.

In a further aspect of the invention, the method of producing a cathode ray tube having a spiral high-resistor which is formed on an inner face of a glass tube and which functions as a main focusing lens for an electron gun is characterized by comprising the steps of: in order to bond a metal part for applying a predetermined potential to the above-mentioned spiral high-resistor to the above-mentioned glass tube, welding the glass tube to the above-mentioned metal part by melting a frit or the glass tube itself; and, after bonding the above-mentioned glass tube to the above-mentioned metal part, removing an oxide film on the surface of the above-mentioned metal part.

Preferably, the step of removing the above-mentioned oxide film is a reduction step by means of heating in a hydrogen or hydrogen-mixture gas atmosphere.

The method of producing a cathode ray tube of the invention is characterized in that the hydrogen or hydrogen-mixture gas atmosphere is formed by passing hydrogen or a hydrogen-mixture gas through a straightening mesh. The entrance of oxygen is prevented from occurring by burning hydrogen.

In the method of producing a cathode ray tube of the invention, the step of removing the above-mentioned oxide film is characterized by comprising the step of immersing in hydrochloric acid or a hydrochloric acid rust removing agent.

Furthermore, the step of removing the above-mentioned oxide film is characterized by comprising the step of, after immersing in hydrochloric acid or a hydrochloric acid rust removing agent, immersing in a neutralizing rust preventing agent.

The step of removing the above-mentioned oxide film is characterized by comprising the step of mechanically shaving off the oxide film. When the oxide film is removed by either of the methods, it is possible to realize a satisfactory connection state between the metal part and the high-resistor film.

In a further aspect of the invention, the method of producing a cathode ray tube having a spiral high-resistor which is formed on an inner face of a glass tube and which functions as a main focusing lens for an electron gun is characterized by comprising the steps of: in order to bond a metal part for applying a predetermined potential to the above-mentioned spiral high-resistor to the above-mentioned glass tube, welding the glass tube to the above-mentioned metal part by melting a frit or the glass tube itself; and flattening the bonded portion between the above-mentioned metal part and the above-mentioned glass tube.

In a further aspect of the invention, the method of producing a cathode ray tube having a spiral high-resistor which is formed on an inner face of a glass tube and which functions as a main focusing lens for an electron gun is characterized by comprising steps of: in order to bond a metal part for applying a predetermined potential to the spiral high-resistor to at least one of open ends of the glass tube, welding the glass tube to the metal part by melting the glass tube itself; and chamfering the inner face in the vicinity of the open end of the glass tube.

In a further aspect of the invention, the method of producing a cathode ray tube having a spiral high-resistor which is formed on an inner face of a glass tube and which functions as a main focusing lens for an electron gun is characterized by comprising the step of, in order to bond a metal part for applying a predetermined potential to the above-mentioned spiral high-resistor to at least one of open ends of the above-mentioned glass tube, welding the glass tube to the above-mentioned metal part by melting the glass tube itself, the inner diameter of the above-mentioned glass tube being larger than the inner diameter of the above-mentioned metal part. According to each of the above-mentioned methods, it is possible to prevent an annular projection from being formed in a connecting portion between the metal part and the glass tube and the connected portion can be flattened.

The cathode ray tube in a further aspect of the invention having a main focusing lens structure in which a high-resistor is formed into a spiral shape by a high-resistance material having a thermal expansion coefficient of 36 to $105\times10^{-7}$/deg. C. is characterized by comprising: metal parts which are used for electrical connection with other electrode parts disposed at both ends of the above-mentioned glass tube; a high-resistor film which is obtained by forming a high-resistor paste into a spiral shape on the above-mentioned glass tube and firing at 420 to 550 deg. C.; and other electrode parts attached to the above-mentioned glass tube.

The above-mentioned cathode ray tube further comprises a focusing voltage supply portion which is disposed in the vicinity of the center of the above-mentioned glass tube.

In the above-mentioned cathode ray tube having the spiral high-resistor which is formed on the inner face of the glass tube and which functions as the main focusing lens for the electron gun, it is characterized in that it comprises a metal part which is bonded to the above-mentioned glass tube by using a frit and which applies a predetermined potential to the above-mentioned spiral high-resistor, and the thermal expansion coefficients of the glass tube, the frit, the metal part, and a material of the spiral high-resistor are in the range of 36 to $105\times10^{-7}$/deg. C.

In the cathode ray tube having a spiral high-resistor which is formed on an inner face of a glass tube and which functions as a main focusing lens for an electron gun, it is characterized in that it comprises a metal part which is welded to the above-mentioned glass tube by melting a frit or the glass tube itself and which applies a predetermined potential to the above-mentioned spiral high-resistor, and the bonding of the above-mentioned glass tube and the above-mentioned metal part is conducted in a reducing gas atmosphere or an inert gas atmosphere.

In the cathode ray tube having a spiral high-resistor which is formed on an inner face of a glass tube and which functions as a main focusing lens for an electron gun, it is characterized in that it comprises a metal part which is welded to the glass tube by melting a frit or the glass tube itself and which applies a predetermined potential to the above-mentioned spiral high-resistor, and the above-mentioned metal part has a film for preventing oxidation.

The above-mentioned film for preventing oxidation is a film formed by one of deposition of gold, gold plating, chromium plating, and nickel plating.

The cathode ray tube of the invention having a spiral high-resistor which is formed on an inner face of a glass tube and which functions as a main focusing lens for an electron gun is characterized in that it comprises a metal part which is welded to the above-mentioned glass tube by melting a frit or the glass tube itself and which applies a predetermined potential to the above-mentioned spiral high-resistor, and, after bonding the above-mentioned glass tube to the above-mentioned metal part, an oxide film on the surface of the above-mentioned metal part is removed.

The cathode ray tube in a further aspect of the invention having a spiral high-resistor which is formed on an inner face of a glass tube and which functions as a main focusing lens for an electron gun is characterized in that it comprises a metal part which is welded to the above-mentioned glass tube by melting a frit or the glass tube itself and which applies a predetermined potential to the above-mentioned spiral high-resistor, and a bonding portion of the glass tube which is welded to the metal part is flattened.

The cathode ray tube in a further aspect of the invention having a spiral high-resistor which functions as a main focusing lens for an electron gun and which is formed on an inner face of a glass tube is characterized in that it comprises a metal part which is welded to at least one of open ends of the above-mentioned glass tube by melting the glass tube itself and which applies a predetermined potential to the above-mentioned spiral high-resistor, and the inner face in the vicinity of the open end of the glass tube is chamfered.

The cathode ray tube in a further aspect of the invention having a spiral high-resistor which functions as a main focusing lens for an electron gun and which is formed on an inner face of a glass tube is characterized in that it comprises a metal part which is welded to at least one of open ends of the above-mentioned glass tube by melting the glass tube itself and which applies a predetermined potential to the above-mentioned spiral high-resistor, and the inner diameter of the above-mentioned glass tube is made larger than the inner diameter of the above-mentioned metal part. According to the configurations, it is possible to prevent an annular projection from being formed in a connecting portion between the metal part and the glass tube, and to flatten the connected portion.

BRIEF DESCRIPTION OF THE SEVERAL VIEWS OF THE DRAWING

The foregoing summary, as well as the following Detailed Description of the Preferred Embodiments of the Invention, will be better understood when read in conjunction with the appended drawings. For the purpose of illustrating the invention, there is shown in the drawings and embodiment which is presently preferred. It should be understood, however, that the invention is not limited to the precise arrangements and instrumentalities shown. In the drawings:

FIG. 1(*b*) is an enlarged section view of the center portion of a main focusing lens.

FIG. 1(*c*) is an enlarged section view of the center portion of another example of a main focusing lens.

FIG. 3(*b*) is an enlarged view of a spiral cutting region.

FIG. 3(*c*) is a plan view of a seal ring.

FIG. 10(*b*) is a partial section view showing a state in which the metal part and the glass tube shown in (*a*) are welded together.

FIG. 11(*b*) is a partial section view showing a state in which the metal part and the glass tube of (*a*) are welded together.

BEST MODE FOR CARRYING OUT THE INVENTION

Embodiment 1

[Structure]

Hereinafter, Embodiment 1 of the invention will be described in detail with reference to FIG. 1 to FIG. 5.

Figure 1:
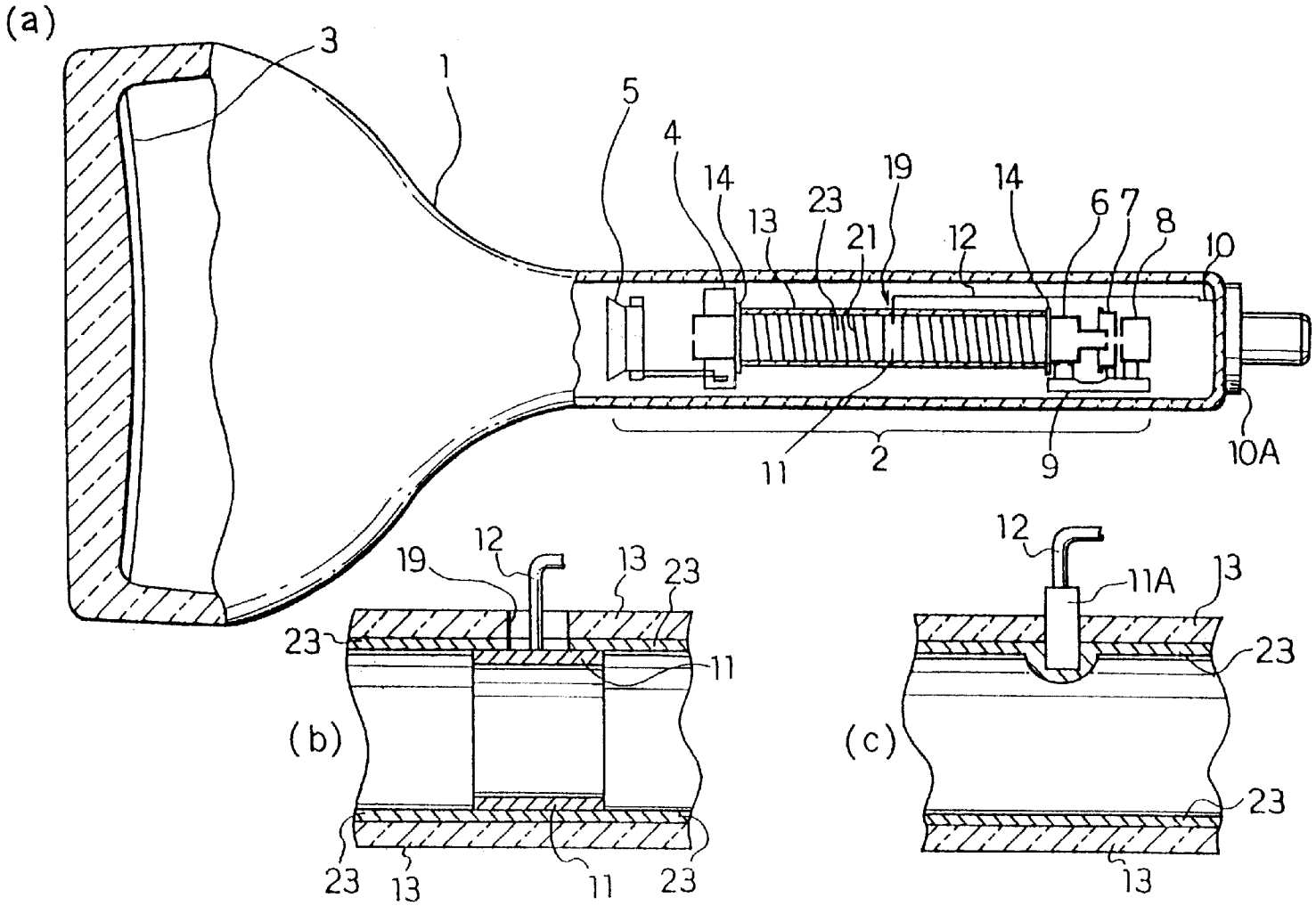
FIG. 1(*a*) is a section view of a cathode ray tube using an electron gun of Embodiment 1 of the invention.

FIG. 1(*a*) shows an example in which the invention is applied to a cathode ray tube for a projection-type TV.

An electron gun 2 of a cathode ray tube 1 of Embodiment 1 comprises a glass tube 13 which has a spiral high-resistor 23 functioning as a main focusing lens on an inner face. A G5 electrode 4 which is formed by working a stainless steel plate, and a getter 5 are disposed in the left end portion of the electron gun 2 which is closer to a fluorescent screen 3. A G3 electrode 6, a G2 electrode 7, and a G1 electrode 8 are supported by a multiform rod 9 in the right end portion of the electron gun 2. Illustration of the cathode is omitted.

As shown in FIG. 1(*b*), a ring-like elastic metal plate 11 is disposed on the inner wall of the center portion of the above-mentioned glass tube 13 so as to contact with the spiral high-resistor 23. One end of a lead wire 12 which passes through a hole 19 of the center portion of the glass tube is welded to the metal plate 11. The other end of the lead wire 12 is welded to an inner pin 10 of a stem 10A.

The glass tube 13 for the main focusing lens is produced by using L29F (an item number of a glass tube produced by Nippon Electric Glass Co., Ltd.) which is of lead silicate glass used in a cathode ray tube of the prior art. L29F glass has a softening point of 620 deg. C., an annealing point (annealing temperature) of 435 deg. C., and a distortion point of 395 deg. C. When the glass tube 13 is heat-treated at the above-mentioned temperature or 450 deg. C., distortion of the glass tube 13 can be eliminated because the temperature is higher than the annealing point of 435 deg. C. Since it is considerably lower than the softening point, the glass tube 13 is not deformed and the initial shape is maintained. A seal ring 14 is bonded to each of both ends of the glass tube 13 by a frit. In order to prevent the seal rings from being oxidized, preferably, the seal rings 14 are previously subjected to deposition of gold, gold plating, chromium plating, nickel plating, or the like. The deposition of gold, the gold plating, the chromium plating, or the nickel plating may be conducted after the glass tube 13 and the seal rings 14 are connected to each other by a method by which an oxide film is not formed on the surfaces. Preferably, a conductive film containing silver (Ag), palladium (Pd), ruthenium (Ru), or the like is formed on the inner faces of both the end portions of the glass tube 13. Preferably, the resistance of the film is not higher than one hundredth of the resistance of the spiral high-resistor 23. The existence of the film allows the electrical connection between the spiral high-resistor 23 and the seal rings 14 to be stably attained. Furthermore, since the potential difference of the connecting portion between the spiral high-resistor 23 and each of the seal rings 14 decreases, distortion of the electric field is reduced, and deformation of the spot shape can be prevented.

L29F glass has the thermal expansion coefficient of $94\times10^{-7}$/deg. C. As materials of the seal rings 14 and the frit, therefore, NS-1 (an item number of a seal ring material produced by Sumitomo Special Metals Co., Ltd.), and 7590 (an item number of a frit material produced by Iwaki G1ass Co., Ltd.) which are listed in Table 1 were used. These materials have a thermal expansion coefficient which is substantially equal to that of L29F glass.

TABLE 1

Thermal expansion coefficients of materials used in Embodiment 1

| Part | Material name: Item number (Manufacturer) | Material name: Thermal expansion coefficient (30 to 380 deg. C.) |
|---|---|---|
| Glass tube | L29F (Nippon electric glass Co., Ltd.) | $94 \times 10^{-7/\text{deg. C.}}$ |
| Frit | 7590 (Iwaki glass company, Limited) | $99 \times 10^{-7/\text{deg. C.}}$ |

TABLE 1-continued

Thermal expansion coefficients of materials used in Embodiment 1

| Part | Material name: Item number (Manufacturer) | Thermal expansion coefficient (30 to 380 deg. C.) |
|---|---|---|
| Seal ring | NS-1 (Sumitomo special metals Co., Ltd.) | $94 \times 10^{-7/\text{deg. C.}}$ |
| High-resistor member material | — | $92 \times 10^{-7/\text{deg. C.}}$ |

[Production method]

Next, an embodiment of the method of producing a cathode ray tube of the invention using the above-mentioned materials will be described with reference to a flowchart of FIG. 2.

Figure 2:
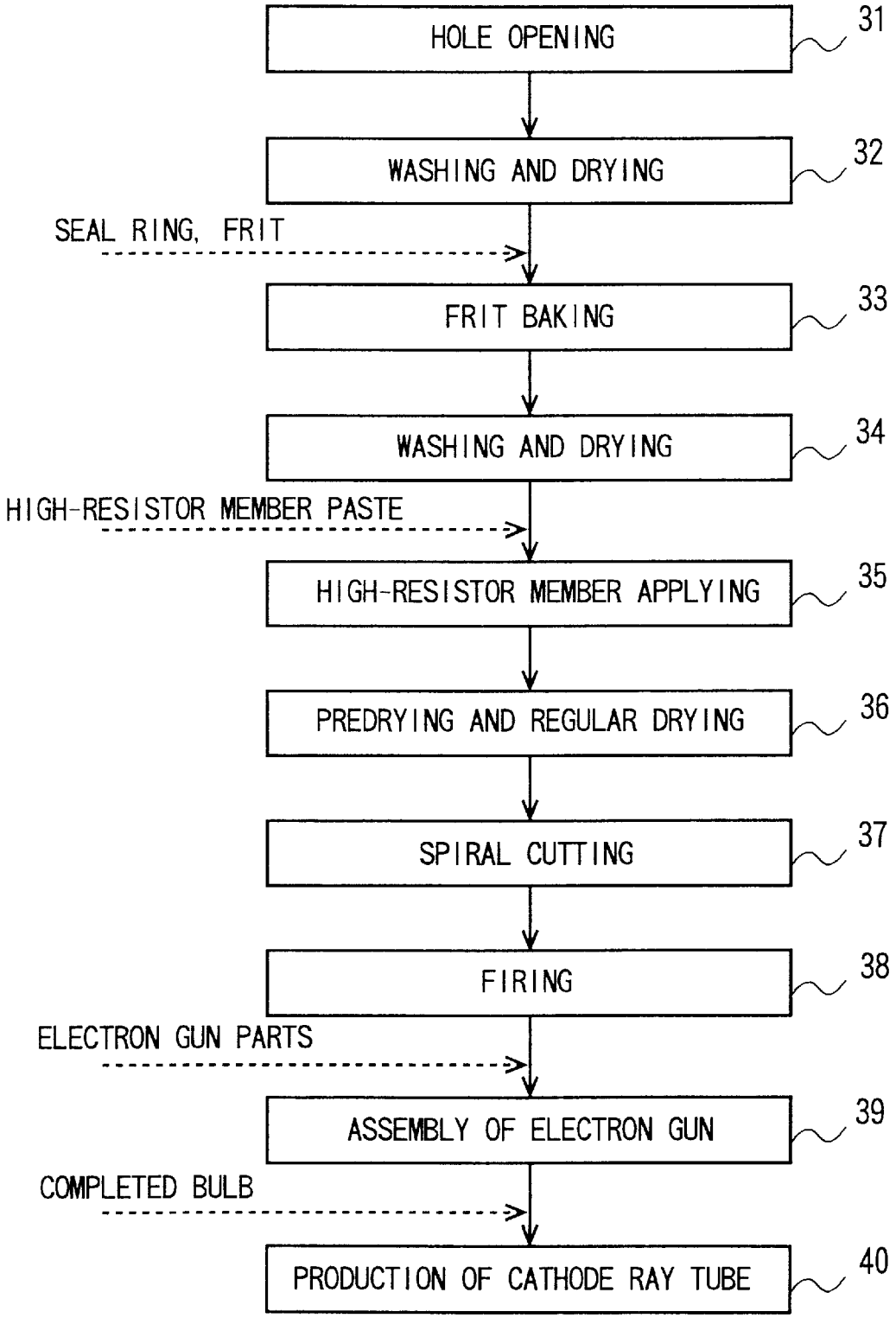
FIG. 2 is a flowchart of steps of producing the cathode ray tube using the electron gun of Embodiment 1.

FIG. 2 mainly shows steps of producing a main focusing lens in which the spiral high-resistor is formed on a glass tube.

Figure 3:
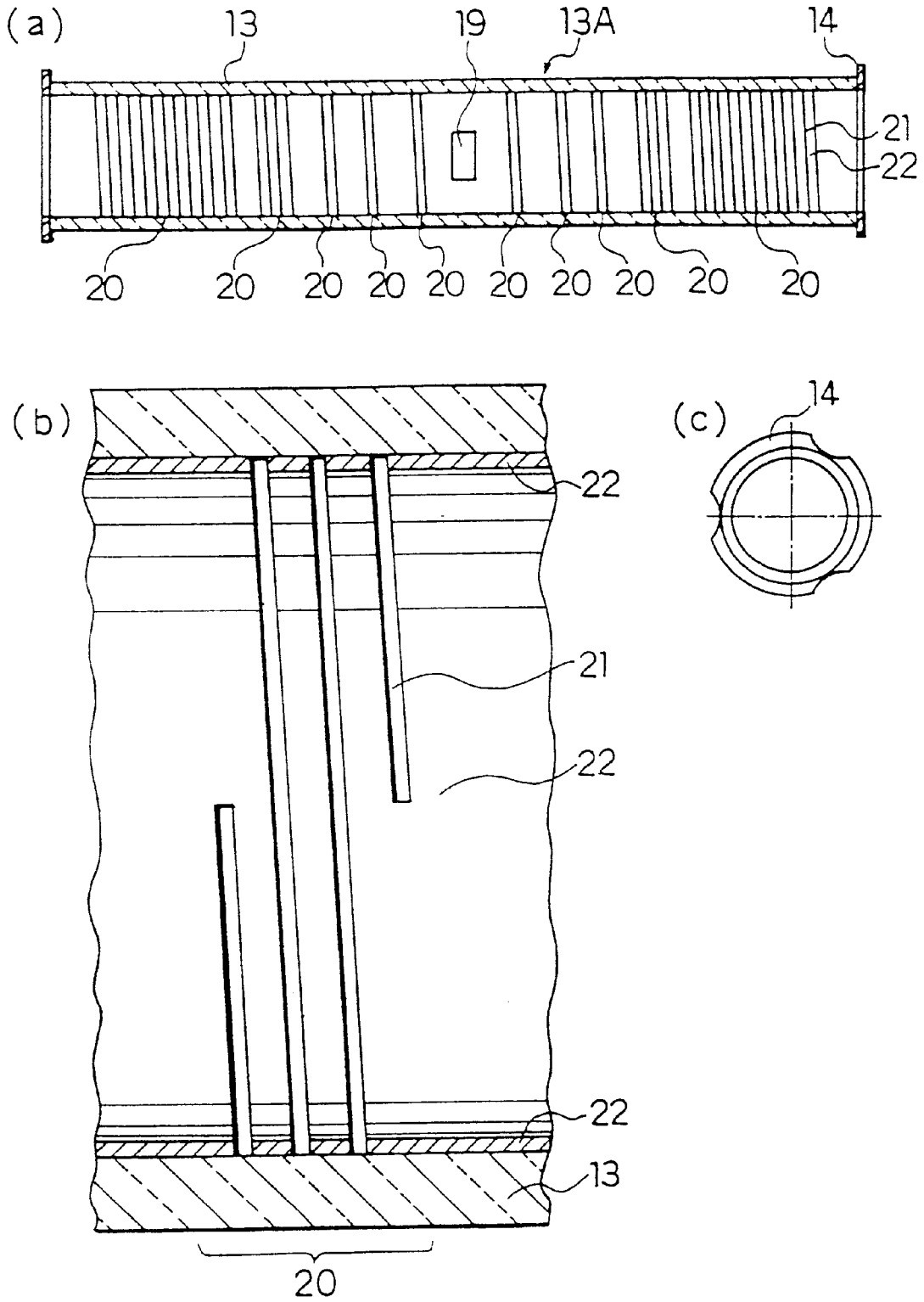
FIG. 3(*a*) is a section view showing a state in which a high-resistor applied to a glass tube of Embodiment 1 is cut into a spiral shape.

FIG. 3(*a*) is a side section view of a main focusing lens 13A. The steps of producing the main focusing lens 13A will be described hereafter. The hole 19 is opened at the center portion of the glass tube 13 by using a file or the like (a hole opening step 31 in the flowchart of FIG. 2). As the method of opening the hole 19, other method such as ultrasonic machining, laser machining, sandblasting, or the like may be employed. The glass tube 13 in which the hole 19 is opened is washed and dried (a washing and drying step 32 in the same), and thereafter the seal rings 14 shown in FIG. 3(*c*) are thermally bonded to it's both ends by using the frit material 7590 shown in Table 1 (a frit baking step 33 in the same). Thereafter, the washing and drying is again conducted (a washing and drying step 34 in the same).

Figure 4:
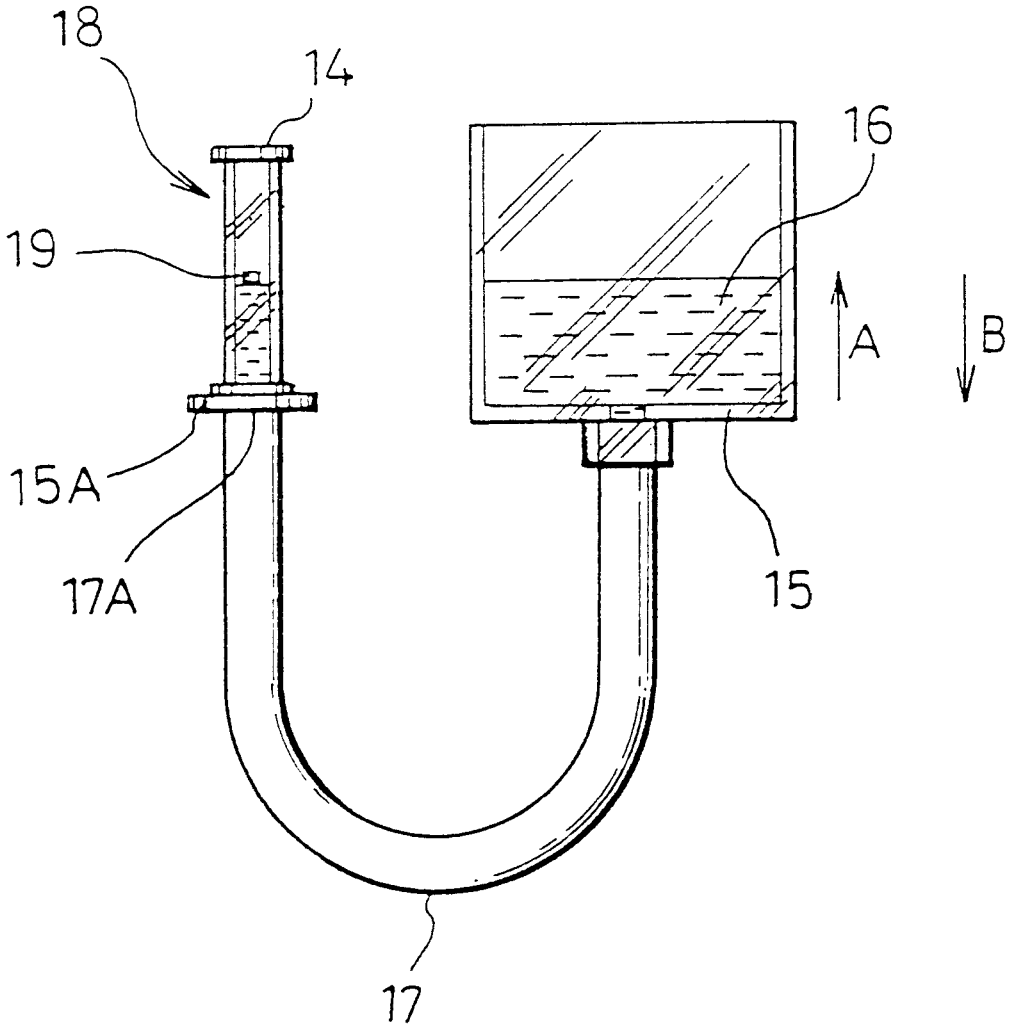
FIG. 4 is a side section view of an apparatus for applying a high-resistor paste by a dip method.

A high-resistor paste 16 which will be described below is applied by the dip method to the glass tube to which the seal rings 14 are bonded in this way (hereinafter, this is referred to as seal ring-attached glass tube 18) (a high-resistor applying step 35). The high- resistor paste 16 is diluted with organic solvent such as toluene, acetone, or methyl ethyl ketone, so as to adjust the viscosity. As shown in FIG. 4, the high-resistor paste 16 is placed in a vessel 15. The vessel 15 is communicated with an application table 15A via a hose 17. The seal ring-attached glass tube 18 is vertically fixed onto the application table 15A, and a tube opening of the seal ring-attached glass tube 18 is closely contacted with a filling hole 17A.

First, the vessel 15 is moved upward as indicated by the arrow A, then, the high-resistor paste 16 in it is poured into the seal ring-attached glass tube 18 via the hose 17 by means of a siphonage. At this time, the level of the vessel 15 is adjusted so that the liquid level of the high-resistor paste 16 stops below the hole 19 of the seal ring-attached glass tube 18. Next, the vessel 15 is lowered as indicated by the arrow B, and the high-resistor paste in the seal ring-attached glass tube 18 is returned into the vessel 15. Immediately after this operation, hot air is blown in the state vertically holding the seal ring-attached glass tube 18, whereby the high-resistor paste 16 is predried (a predrying and regular drying step 36).

A film thickness which is more uniform can be obtained by adequately combining the viscosity of the paste 16 and the lowering speed of the vessel 15, and by dissipating the solvent by the subsequent hot-air drying. Next, the seal ring-attached glass tube 18 is vertically inverted, and the high-resistor paste 16 is applied to the side lower than the hole 19 in the same method as described above. The high-resistor film which is obtained in this way has a thickness of 5 to 10 $\mu$m. Finally, the high-resistor paste is applied by a brush or the like to a portion which is in the vicinity of the hole 19 and to which no high-resistor paste adheres.

The high-resistor paste 16 is mainly a mixture of 0.5 to 5 wt. % of fine powder of ruthenium oxide and the remnant of powder of lead borosilicate glass having a thermal expansion coefficient of 90 to $100\times10^{-7}$/deg. C. A small amount of an additive of a metal oxide or an organic metal, and an organic binder are added to the mixture.

If an example is shown, powder of ruthenium oxide of a mean particle diameter of 0.3 $\mu$m and powder of glass (glass composition is PbO 77 wt. %; $B_2O_3$ 18 wt. %; and $SiO_2$ 5 wt. %) of a mean particle diameter of 1.5 $\mu$m are mixed with each other at the weight ratio of 3 to 97. Terpineol into which 10% of ethyl cellulose is dissolved as the organic binder, and a small amount of copper oxide are added to the mixture. This mixture is kneaded by a three-roll kneader, thereby producing the high-resistor paste 16.

The combination of the high-resistor materials of the high-resistor paste 16 was conducted in consideration of the following three points.

As a first point, the thermal expansion coefficient of the high-resistor material was made coincident with the thermal expansion coefficient of the materials of the glass tube 13, the metal plate 11, and the seal rings 14 of the other three parts. Thereby, it is possible to prevent a crack and separation due to the heat treatment from occurring in the high-resistor film. Furthermore, it is possible to prevent the glass tube 13 and the seal rings 14 from being separated from each other. Table 1 shows an example of the thermal expansion coefficients of the materials use in the embodiment. In a practical use, the glass tube 13, the frit material, the seal rings 14, and the high-resistor material constituting the electron gun 2 have a thermal expansion coefficient in the range of 85 to $105\times10^{-7}$/deg. C.

As a second point, in order to eliminate distortion of the glass tube 13, the softening point of the glass powder of the high-resistor material is selected so as to be lower than the annealing point of the glass tube 13. In the embodiment, since the annealing point of the glass tube 13 is 435 deg. C., the softening point is set to be lower than it or 430 deg. C. In order that ruthenium oxide of the conductive fine particles and the glass powder which is a nonconductive material melt and the ruthenium oxide uniformly enters the glass film to form a high-resistor, the high-resistor material must be fired at a temperature higher than softening point. Therefore, 450 deg. C. is suitable as the firing temperature.

The above-mentioned first and second points were realized mainly by setting the composition ratio of the glass powder to PbO 77 wt. %; $B_2O_3$ 18 wt. %; and $SiO_2$ 5 wt. % as described above.

As a third point, the size in the cutting of the applied high-resistor material into a spiral shape is selected to be an appropriate value. As described above, the mixing ratio of ruthenium oxide to the glass powder was determined to be 3 to 97 so that the objective resistance is attained when the firing is conducted at a firing temperature of 450 deg. C. and a firing time of 10 minutes.

Next, the seal ring-attached glass tube 18 to which the high-resistor paste 16 is applied is subjected to the regular drying at about 250 deg. C. (the predrying and regular drying step 36). Then, the seal ring-attached glass tube 18 is rapidly rotated about the axis by a lathe, and the high-resistor film 22 applied to the inner face of the seal ring-attached glass tube 18 is cut by a cemented carbide tool into a spiral shape to form cutting regions 20 (a spirally cutting step 37).

In the cutting, as shown in FIG. 3(*a*), five spiral cutting regions 20 are disposed in each of the left and right halves so as to be symmetrical about the hole 19 of the glass tube 13. In FIG. 3(*a*), the spiral cutting regions 20 and non-cut portions are alternatingly arranged. The cutting width and the pitch may be changed as required. An example is shown in FIG. 3(*b*) which is an enlarged view of the spiral cutting regions 20. In FIG. 3(*b*), portions in which the high-resistor film is removed away by the cutting are indicated by grooves 21. In both FIG. 3(*a*) and FIG. 3(*b*), the high-resistor film 22 is indicated by oblique lines of the same direction. Incidentally, the spiral grooves 21 may be cut at the equal pitches in the axial direction of the glass tube 13.

The grooves 21 of the spiral high-resistors 23 shown in FIG. 1 are evenly cut in the axial direction of the glass tube 13 except the center portion of the glass tube 13. In FIG. 1, the grooves 21 after cutting are indicated by oblique solid lines in the same manner as the grooves 21 shown in FIG. 3(*a*), and, the spiral high-resistor 23 exists in the blank portions. Therefore, the spiral pattern shown in FIG. 1 is different from the spiral pattern which is shown in FIG. 3(*a*) and which is unevenly formed in the axial direction of the glass tube 13.

The glass tube 13 on which the spiral grooves 21 are formed is vertically disposed and is then fired at 450 deg. C. for 10 minutes (a firing step 38). After the firing process, the metal plate 11 is attached to the inner wall of the hole 19 of the glass tube 13. Incidentally, as shown in FIG. 1(*c*), in place of the metal plate 11, a pin 11A may be inserted into the hole 19 and, before the firing process, the high-resistor paste may be applied so as to cover the pin 11A and the high-resistor film 22.

By the above-mentioned firing process, the organic binder decomposes and burns. The high-resistor film 22 is vitrified and fixedly bonded in the seal ring-attached glass tube 18, so as to constitute the spiral high-resistor 23. The resistor has a thickness of 3 to 6 $\mu$m. The above-mentioned firing process causes the spiral high-resistor film 23 to be electrically connected to the respective seal rings 14 in both the end portions of the glass tube 13. In the center portion of the glass tube 13, moreover, both the right and left portions of the spiral high-resistor 23 are electrically connected to the metal plate 11.

The properties of the spiral high-resistor film 23 which was formed in accordance with the invention are shown in Table 2. The case which was formed by using ruthenium hydroxide is shown as a conventional example. As apparent from Table 2, in the case of the invention, the use of a paste-like high-resistor material allows the film thickness to be increased. As a result, the resistance is 20 GΩ or lower than that of the conventional example, and the dispersion of the resistance can be largely reduced.

TABLE 2

Properties of spiral high-resistance of the conventional example and the invention

| | Firing temperature | Film thickness | Resistance | Dispersion of resistance |
|---|---|---|---|---|
| Conventional example | 450 deg. C. | 1.3 $\mu$m | 26 GΩ | ±70% |
| Embodiment | 450 deg. C. | 4.5 $\mu$m | 20 GΩ | ±20% |

The spiral high-resistor 23 functioning as the main focusing lens of the cathode ray tube 1 is to give a potential distribution between the anode voltage and the focus voltage, and must have a high resistance in order to make little current flow.

The target value of the resistance of the spiral high-resistor 23 is set to be about 20 GΩ under the state cut into a spiral shape as shown in FIG. 3(*a*). When the positive anode voltage of 32 KV is applied to the seal rings 14 of both ends of the glass tube 13 of FIG. 1 and the positive focus voltage of 7 kV is applied to the metal plate 11, for example, a leak current (Ig4) flowing through the spiral high-resistor 23 is about (32 KV−7 kV)/20 GΩ=1.25 $\mu$A. Since the current value becomes such as this, the operation of the cathode ray tube 1 is not substantially affected and a stable operation is ensured.

The resistance of the spiral high-resistor 23 must be within a predetermined range. In other words, when the resistance becomes too high, for instance 1 TΩ, almost no leak current flows, and therefore a required potential distribution cannot be obtained and the potential becomes unstable owing to the dielectric function of the glass. According to experiments conducted by the inventor et al., 100 GΩ or lower is preferable. In the above-mentioned case where the anode voltage is 32 KV and the focus voltage is 7 kV, a leak current (Ig4) of 0.25 $\mu$A or larger must flow.

Conversely, when the resistance is too low, a large leak current (Ig4) flows, therefore, a potential difference is produced across resistors (not shown) which are connected in series to an electrode (in the embodiment, G4) for supplying the focus voltage in order to form the main focusing lens, thereby changing the focus voltage. When the leak current (Ig4) is changed, particularly, the focus voltage is changed. In order to prevent such a change from occurring, the leak current (Ig4) must be 30 $\mu$A or less and the resistance must be 0.8 GΩ or higher.

Next, as shown in FIG. 1 the parts from the G3 electrode 6 to the G1 electrode 8 which have been preliminarily assembled on the multiform rod 9 are welded to the right side seal ring 14, and the parts from the G5 electrode 4 to the getter 5 are welded to the left side seal ring 14, thereby completing the electron gun 2 (an electron gun assembling step 39). Next, the electron gun 2 is enclosed into the completed bulb in which the fluorescent screen and the like are disposed. The subsequent steps are identical with the production method of a conventional cathode ray tube and hence their description is omitted (a cathode ray tube producing step 40).

[Comparison of performance between Embodiment 1 and conventional example]

Figure 5:
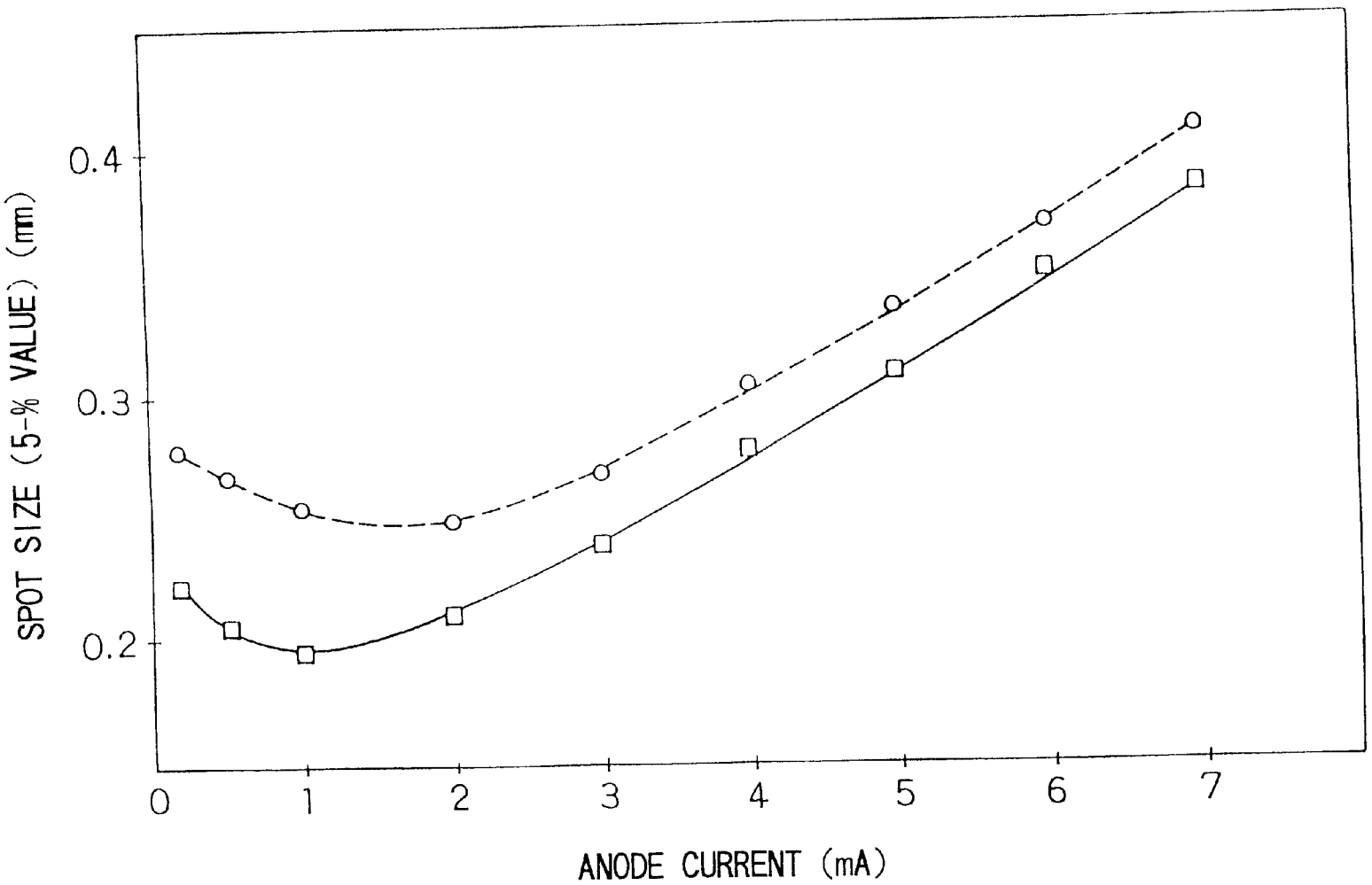
FIG. 5 is a graph showing comparisons between a spot size of the cathode ray tube of Embodiment 1 and the spot size of the cathode ray tube of the prior art.

FIG. 5 shows a spot size of the cathode ray tube of the invention and a spot size of a conventional one. The abscissa indicates the anode current and the ordinate indicates the spot size. The spot sizes indicated by the solid line of the cathode ray tube obtained by the production method of the invention can be made smaller than the spot sizes indicated by the broken line of the conventional one over the range of the anode current from the small current region to the large current region. Accordingly, compared with a conventional cathode ray tube in which the main focusing lens is formed by a combination of metal electrodes, very good resolution properties can be obtained.

Incidentally, in the above-mentioned embodiment, a unipotential (UPF) type electron gun in which symmetric voltages are supplied across the connecting point disposed in the center hole 19 of the glass tube 13 and two connecting points closer to both the ends of the glass tube has been shown. The invention may be applied also to an electron gun of another type, or a bipotential (BPF) type electron gun. In this case, the connecting point disposed in the center hole 19 of the glass tube 13 is not required and the anode voltage and focus voltages are respectively supplied to metal electrodes connected to both the ends of the glass tube 13.

Embodiment 2

Embodiment 2 will be described with reference to FIG. 6 to FIG. 11.

Embodiment 2 relates to a glass tube assembly in which a spiral high-resistor functioning as a main focusing lens of an electron gun of a cathode ray tube is disposed.

[Configuration of the glass tube assembly]

Figure 6:
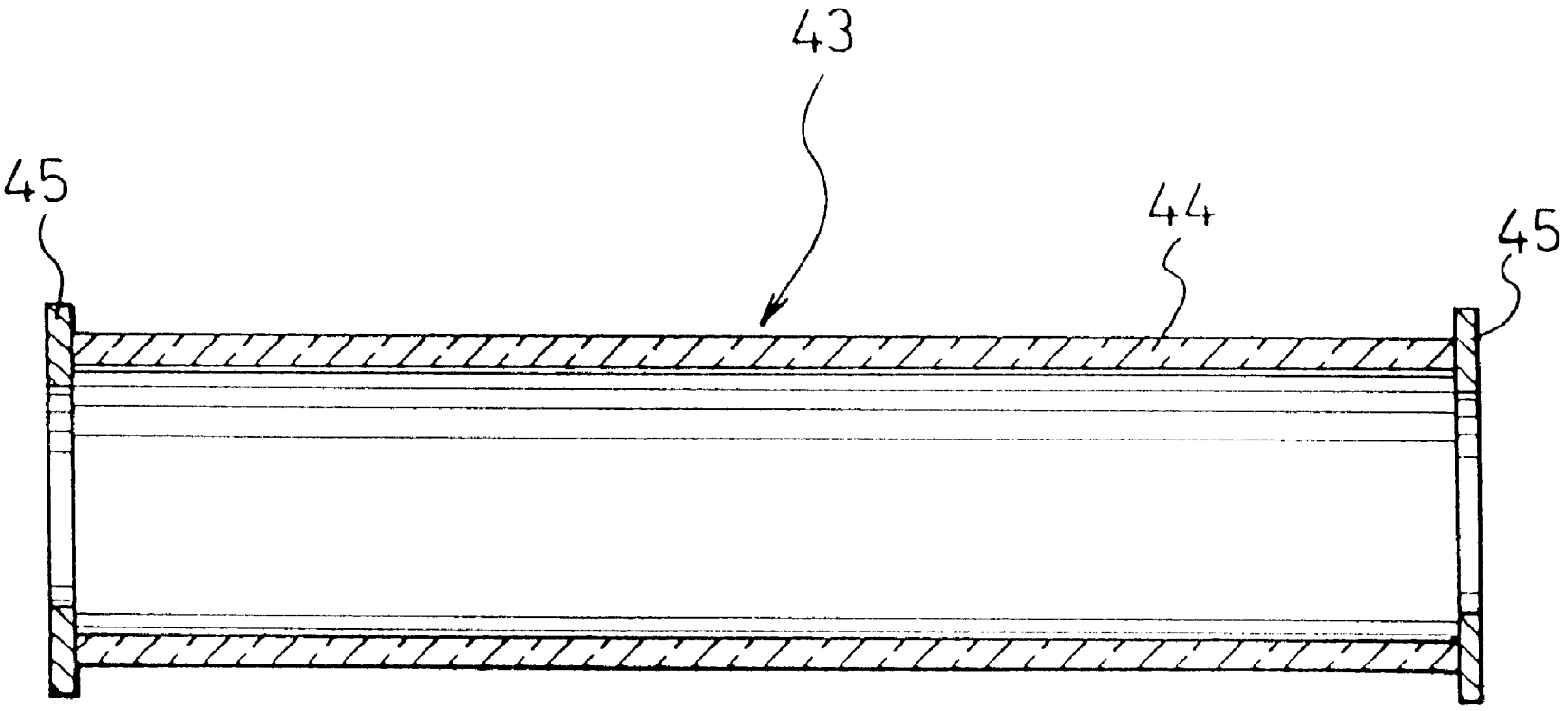
FIG. 6 is a side section view of a glass tube member of a cathode ray tube of Embodiment 2 according to the invention.

FIG. 6 is a side section view of a glass tube assembly 43. The glass tube assembly 43 is configured of a glass tube 44, and seal rings 45 which are metal parts attached to both ends of the glass tube 44. The glass tube 44 is substantially identical in shape with the glass tube 13 of Embodiment 1, but different in material therefrom. Also the seal rings 45 are different in material from the seal rings 14 of Embodiment 1.

As the material of the glass tube 44, BCL which is borosilicate glass or SKC which is soda glass is used. BCL and SKC are product names of the respective manufacturers and their composition and properties are shown in Table 4 (sic). As shown in Table 3, BCL and SKC are lower in volume resistivity than L-29F.

TABLE 3

| Composition and properties | Name of glass tube material | | |
|---|---|---|---|
| | L-29F | BCL | SKC |
| PbO (wt. %) | 28.0 | 0 | 0 |
| $SiO_2$ (wt. %) | 60.0 | 72.0 | 70.3 |
| $Al_2O_3$ (wt. %) | 1.0 | 7.0 | 2.0 |
| $B_2O_3$ (wt. %) | 0 | 10.5 | 1.2 |
| MgO (wt. %) | 0 | 0 | 2.8 |
| CaO (wt. %) | 0 | 0.5–1.0 | 5.9 |
| BaO (wt. %) | 0 | 1.5–2.0 | 0 |
| $Na_2O$ (wt. %) | 8.0 | 7.5 | 16.0 |
| $K_2O$ (wt. %) | 3.0 | 7.5 | 1.3 |
| Softening point (deg. C.) | 615 | 785 | 694 |
| Annealing point (deg. C.) | 435 | 570 | 525 |
| Thermal expansion coefficient × $10^{-7}$/deg. C. | 94 | 52 | 98.5 |
| Volume resistivity logρ: Ωcm (100 deg. C.) | 13.4 | 11.1 | 10.4 |

When a current flows through the spiral high-resistor 20 formed on the inner face of the glass tube 13 as shown in FIG. 3(*b*), charges are accumulated in the bottoms of the grooves 21, i.e., the surface of the glass tube. The amount of accumulated charges varies in accordance with the volume resistivity of the glass, and as the volume resistivity is smaller the amount is smaller. The inventor has found that charges accumulated in the bottoms of the grooves 21 influence the operation of the main focusing lens, and this influence causes the shape of a spot on the display screen to be irregularly varied. Therefore, it is preferable to reduce charges accumulated in the bottoms of the grooves 21 to an amount as small as possible. In the embodiment, since the glass tube 44 is produced by using BCL or SKC which is a glass material having a relatively low volume resistivity, charges accumulated in the glass surface of the grooves 20 can be reduced and the above-mentioned irregular variation of the spot shape can be suppressed.

In the case where BCL is used as the material of the glass tube 44, a high-resistor paste which is applied to the inner face of the glass tube 44 will be described hereafter. Since the thermal expansion coefficient of BCL is $52\times10^{-7}$/deg. C. as shown in Table 4 (sic), resistor materials 3, 4, and 5 which have a thermal expansion coefficient of 55 to $60\times10^{-7}$/deg. C. are suitable as the resistor material which is used in the high-resistor paste. It is possible to prevent the high-resistor film from being peeled off from the glass tube 44 by using materials of each other thermal expansion coefficients in the glass tube and the high-resistor. In the case where a material into which a filler is added is used as the resistor material, since the homogeneity of the dispersant film is slightly inferior, it is preferable to use a resistor material 3 which contains a smaller amount of lead. In this case, since glass particles have a softening point as high as 515 deg. C., the firing temperature must be raised to about 520 to 550 deg. C.

TABLE 4

| Composition and properties | Name of resistor material | | | | |
|---|---|---|---|---|---|
| | Resistor material 1 | Resistor material 2 | Resistor material 3 | Resistor material 4 | Resistor material 5 |
| $RuO_2$ (wt. %) | 8 | 3 | 10 | 10 | 8 |
| PbO (wt. %) | 66 | 74.5 | 36 | 48 | 52 |
| $B_2O_3$ (wt. %) | 16 | 17.5 | 15 | 11 | 12 |
| $SiO_2$ (wt. %) | 7 | 5 | 5.5 | 1.5 | 2 |
| ZnO (wt. %) | 2.8 | 0 | 31.5 | 3 | 3 |
| $Al_2O_3$ (wt. %) | 0.2 | 0 | 1 | 2 | 2 |
| $SnO_2$ (wt. %) | 0 | 0 | 1 | 0 | 0 |
| $ZrO_2$ filler (wt. %) | 0 | 0 | 0 | 16.5 | 14 |
| $SiO_2$ filler (wt. %) | 0 | 0 | 0 | 8 | 7 |
| $Al_2O_3$ filler (wt. %) | 0 | 0 | 0 | 0 | 0 |
| Softening point (deg. C.) | 490 | 430 | 515 | 430 | 430 |
| Annealing point (deg. C.) | 395 | 365 | 440 | 365 | 365 |
| Thermal expansion coefficient × $10^{-7}$/deg. C. | 80 | 90 | 60 | 55 | 55 |

[Welding of the glass tube and the metal parts]

As shown in FIG. 6, the seal rings 45 as metal parts are attached to both ends of the glass tube 44. The glass tube 44 and the seal rings 45 are welded to each other by using a frit or are welded by melting the glass tube 44 itself. The glass tube 44 and the seal rings 45 must be produced by using materials of each other close thermal expansion coefficients. In the case where the glass tube 44 is made of BCL, since the thermal expansion coefficient is $52\times10^{-7}$/deg. C., KV-2, KV-15, YEF-29-7, DK, or the like which has a thermal expansion coefficient of 44 to $55\times10^{-7}$/deg. C. as shown in Table 5 is used as the metal material of the seal rings 45. In the case where the glass tube 44 is made of SKC., since the thermal expansion coefficient is $98.5\times10^{-7}$/deg. C., NS-1 which has a thermal expansion coefficient of 94 to 100 is used as the metal material of the seal rings 45. When the glass tube 44 and the seal rings 45 are welded by a frit material, the thermal expansion coefficient of the frit material must be coincident with the thermal expansion coefficient of the glass tube 44. From the points mentioned above, materials having a thermal expansion coefficient in the range of 36 to $105\times10^{-7}$/deg. C. are used for the glass tube 44, the frit, the seal rings 45, and the high-resistor which is applied to the inner face of the glass tube 44 in a later step.

TABLE 5

| Name of metal | Manufacturers | | | | |
|---|---|---|---|---|---|
| | Sumitomo Special Metals Co., LTD. | | | Hitachi Metals LTD. | Nippon Mining Co., LTD. |
| material | NS-1 | KV-2 | KV-15 | YEF-29-17 | DK |
| Thermal expansion | 94–100 | 44–52 | 46 | 48 | 44–55 |

TABLE 5-continued

| Name of metal | Manufacturers | | | | |
|---|---|---|---|---|---|
| | Sumitomo Special Metals Co., LTD. | | | Hitachi Metals LTD. | Nippon Mining Co., LTD. |
| material | NS-1 | KV-2 | KV-15 | YEF-29-17 | DK |
| coefficient × $10^{-7}$/ deg. C. (30–400 deg. C.) | | | | | |

The glass tube 44 and the seal rings 45 are welded by heating them at the temperature of 800 deg. When this heating is conducted in the air, an oxide film is formed on the surfaces of the seal rings 45. It is known that the oxide film enhances the bond strength between glass and metal. In this respect, therefore, the existence of the oxide film is preferable. On the other hand, when the high-resistor film was formed in the glass tube 44 in the later step, there is a case where the electrical connection between the high-resistor film and the seal rings 45 becomes incomplete. In the embodiment, the following various countermeasures are taken in order to prevent an oxide film from being formed on the surfaces of the seal rings 45.

[Method of suppressing oxidation of the seal rings]

In the method, immediately after the seal rings 45 are welded to the glass tube 44 in the air, the glass tube 44 having the seal rings 45 is placed in a reducing gas atmosphere such as hydrogen or an inert gas atmosphere such as nitrogen. By means of this process, the formation of the oxide film on the surfaces of the seal rings 45 can be suppressed. This process may be applied also to the metal plate 11 shown in FIG. 1 functioning as the focusing voltage supply portion in a similar manner.

[Method and apparatus for preventing the seal rings from being oxidized]

Although it has been described in Embodiment 1, that, as a countermeasure for preventing the seal rings from being oxidized, a surface treatment such as deposition of gold, gold plating, chromium plating, or nickel plating is previously conducted, in the embodiment, the objective is to prevent oxidation from occurring, without conducting such a previous surface treatment.

(Oxidation prevention by means of an inert gas)

Figure 7:
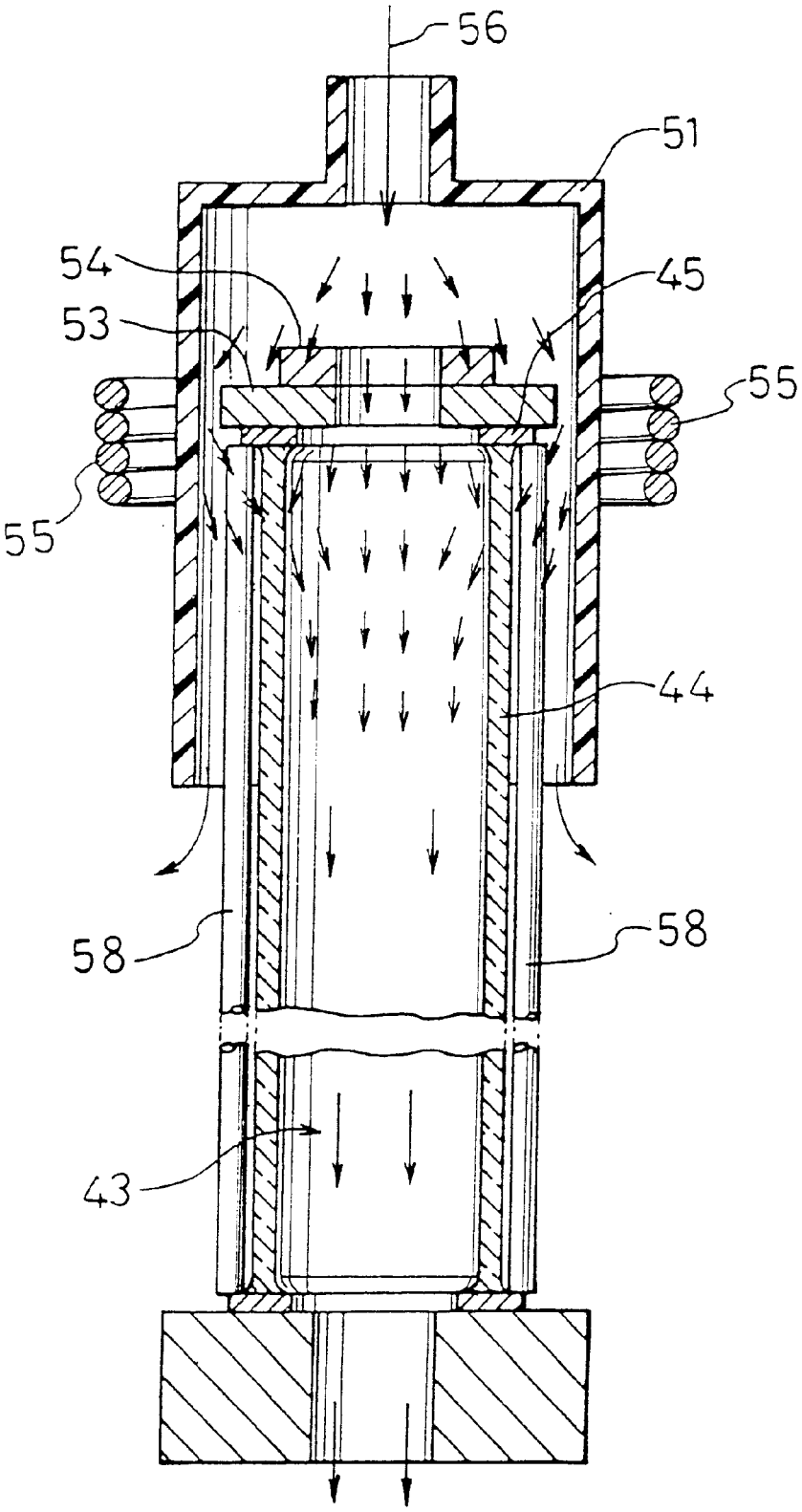
FIG. 7 is a side section view of an oxidation preventing apparatus in Embodiment 2.

FIG. 7 is a section view showing main portions of a welding apparatus for welding the glass tube 44 and the seal ring 45 together in an atmosphere of an inert gas such as nitrogen gas. In the welding apparatus, the glass tube 44 is welded to the seal ring 45 by melting the glass tube itself and without using a frit. In the figure, a shielding tube 51 is the tube of a heat resistant insulator which has a blowing hole 52 for introducing nitrogen gas in the upper portion. The inner diameter of the shielding tube 51 is made larger than the outer diameters of the glass tube 44 and the seal ring 45 by a predetermined size. The glass tube 44 and the seal ring 45 are inserted into the shielding tube 51 by a jig which is not shown, by maintaining a predetermined positional relationship. A carbon block 53 having a hole 53A in the center portion is placed on the seal ring 45, and a metal block 54 which has a hole 54A in the center portion and which functions as a weight is placed on the carbon block 53. The carbon block 53 is made of carbon because melting glass does not adhere with carbon. The outer diameters of the carbon block 53 and the metal block 54 are made smaller than the inner diameter of the shielding tube 51.

A heating coil 55 for conducting high frequency induction heating is disposed in the vicinity of the seal ring 45 on the outer periphery of the shielding tube 51. Three or six restriction rods 58 made of ceramics are disposed in the shielding tube 51 in order to restrict a melting length of the glass tube 44 during the welding process (hereinafter is referred to as melting margin). During a period when the glass tube 44 and the seal rings 45 are welded, the upper end of the glass tube 44 melts and the length of the tube is reduced, so that the seal ring 45 is lowered by the gravity of the metal block 54. When the seal ring 45 is lowered by a predetermined distance, the lower face abuts against the upper ends of the restriction rods 58, thereby inhibiting further lowering. As a result, the melting margin of the glass tube can be restricted to a predetermined value (0.2 to 0.3 mm).

Next, the operation of the welding apparatus will be described. As indicated by an arrow 56, an inert gas such as nitrogen gas is introduced through the blowing hole 52 of the shielding tube 51. The inert gas enters the interior space of the glass tube 44 through the respective holes 54A and 53A of the metal block 54 and the carbon block 53. Furthermore, the inert gas enters the space between the outer wall of the glass tube 44 and the inner wall of the shielding tube 51, through a gap between the inner wall of the shielding tube 51 and the outer peripheral faces of the metal block 54, the carbon block 53, and the seal ring 45. Since the inert gas flows through the spaces inside and outside the glass tube 44, the seal ring 45 is placed in the inert gas atmosphere so as not to be contacted with oxygen.

Subsequently, a high frequency current is supplied to the heating coil 55 to heat the seal ring 45, and the end portion of the glass tube 44 contacted with the seal ring 45 melts and both are bonded. During the above-mentioned heating process, since the seal ring 45 is in the inert gas atmosphere, the surface is not oxidized.

In the welding apparatus shown in FIG. 7, the seal ring 45 and the end region of the glass tube 44 contacted therewith is mainly heated by local heating by the high frequency induction heating. Therefore, the temperature of the glass tube 44 as a whole is not highly raised and hence it is possible to prevent the glass tube 44 from being thermally deformed. Since a softening point of the material of the glass tube 44 is 785 deg. C., in place of using the above-mentioned reduction apparatus, when the whole of the glass tube 44 is placed in an oven of a temperature of 800 deg. C. or higher and a welding process is conducted, the whole of the glass tube 44 is liable to be deformed. In the welding apparatus of the embodiment, only the portion corresponding to the seal ring 45 is heated and hence deformation of the whole of the glass tube 44 does not occur.

[Method and apparatus for removing an oxide film of the seal ring]

In the case that a welding process is conducted without depending on the above-described oxidation preventing method, description is made as to a method and an apparatus for removing an oxide film formed on the surface of the seal ring 45 hereafter. When the glass tube 44 and the seal ring 45 are welded together by a frit, or when a frit is not used and the glass tube 44 is welded to the seal ring 45 by melting the glass tube itself, if they are heated in the air, the surface of the heated seal ring is oxidized and an oxide film is formed. When an oxide film is formed on the surface of the seal ring 45, the electrical connection between the high-resistor film and the seal ring 45 becomes unstable due to the oxide film. With respect to this point, there arises a similar problem also when the metal plate 11 of the focusing voltage supply portion is attached before the application of the high-resistor paste.

(Apparatus for removing an oxide film by a reducing gas)

Figure 8:
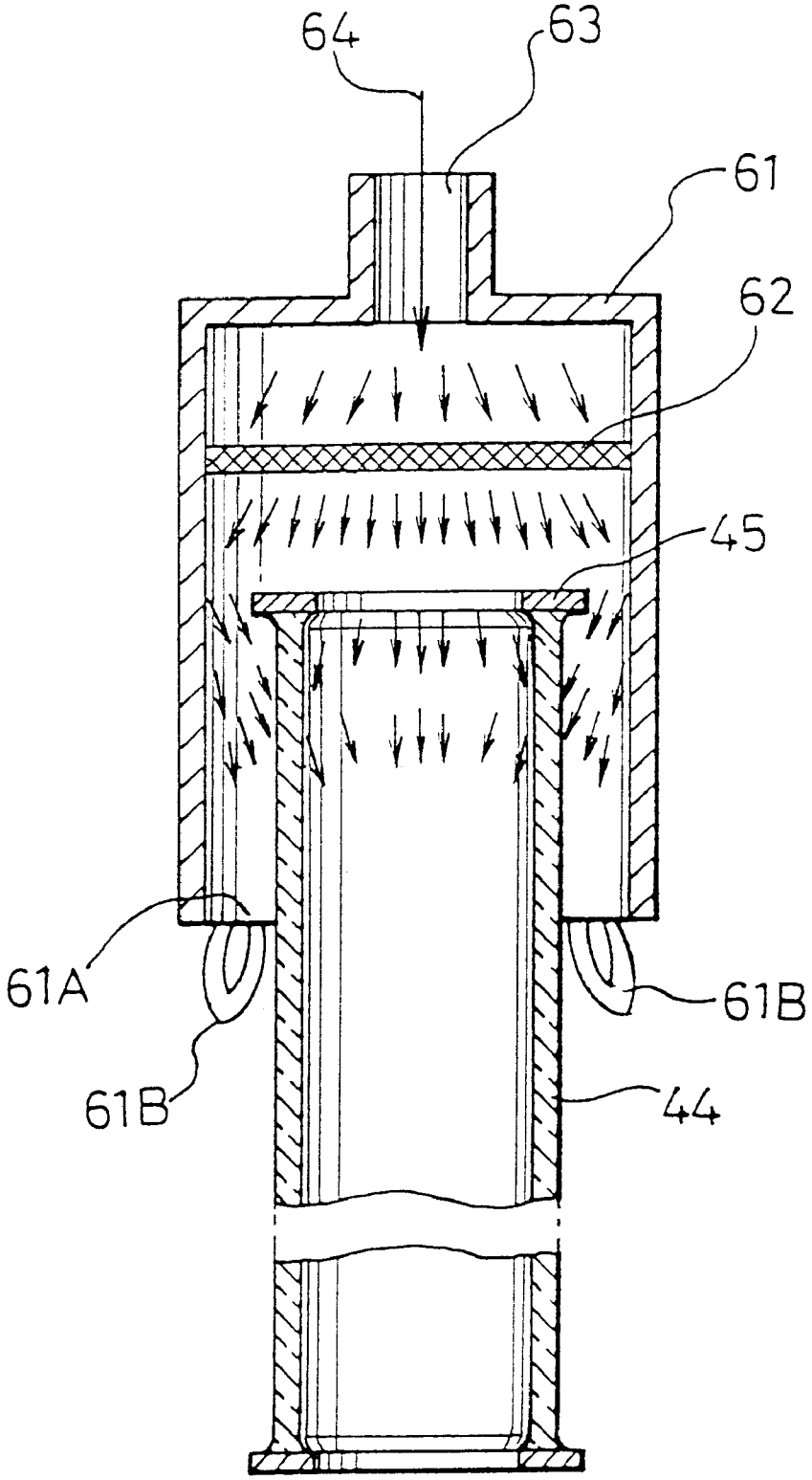
FIG. 8 is a side section view of a reduction apparatus by a reducing gas of Embodiment 2.

FIG. 8 shows a reduction apparatus for reducing the seal ring 45 having an oxide film in a reducing gas. In the figure, a shielding tube 61 of the reduction apparatus is a tube which has heat resistance, and has a blowing hole 63 for the reducing gas at an upper end part of the figure. A straightening mesh 62 which is formed by a wire net or the like is disposed in the tube which is separated from the blowing hole 63 by a predetermined distance so as to be perpendicular to the center axis of the tube. The glass tube 44 to which the seal ring 45 is welded is inserted to a position which is separated from the straightening mesh 62 by a predetermined distance. As indicated by an arrow 64, hydrogen gas serving as a reducing gas is introduced through the blowing hole 63. The introduced hydrogen gas is straightened by the straightening mesh 62, so that the distribution of the flow rate becomes uniform in the shielding tube 61 after passing through the straightening mesh 62.

The reducing operation by the apparatus is conducted as follows. After the seal ring 45 is welded to the glass tube 44 by heating in the air, the glass tube 44 having the seal ring is inserted into the shielding tube 61 under the state where the temperature of the seal ring 45 is high. In the shielding tube 61, the hydrogen gas contacts with the seal ring 45 of a high temperature and the oxide on the surface of the seal ring 45 is reduced by the hydrogen gas. Since the flow rate of the hydrogen gas is uniformalized by the straightening mesh 62, the surface of the seal ring 45 is reduced uniformly.

In the reduction apparatus by the hydrogen gas shown in FIG. 8, when the hydrogen gas blown from a lower opening 61A of the shielding tube 61 is ignited, flame 61B is formed and the hydrogen gas burns. The inventor has found that, when hydrogen gas burns in this way, it is possible to prevent the air from entering the shielding tube 61 through the opening 61A at the lower end of the shielding tube 61. Since the entrance of the air is inhibited, the seal ring 45 is reduced more satisfactorily and uniformly. Although, an oxide film is formed on the seal ring 45 as a result of the heating in the air, the oxide film has a function of enhancing the bonding strength between the seal ring 45 and the glass tube 44. Therefore, when the welding process is conducted in the air and, after the welding, the surface oxide film of the seal ring 45 is reduced by hydrogen gas and removed away, it is possible to attain a high bonding strength and also to prevent a contact failure between the seal ring 45 and the high-resistor film 22 from occurring when the high-resistor film 22 is formed in a later step.

(Removal of an oxide film by a chemical process)

Next, a method of removing an oxide film of the seal ring 45 by a chemical process will be described. Chemical which is used is hydrochloric acid or a hydrochloric acid rust removing agent. Commercially available products of such chemicals include a liquid rust preventing agent which has a product name of JASCO RS-207 and is produced by JAPAN SURFACE COMPANY.

In the case that JASCO RS-207 is used, it is immersed in the liquid of a predetermined concentration and temperature for several to ten-odd minutes. Then, an oxide film which raises to the surface of the seal ring 45 is rubbed off with cloth or the like and then washed away by water. In order to prevent an oxide film from being again formed, it is immersed in an alkaline neutralizing rust preventing agent. As the neutralizing rust preventing agent, for example, JASCO M-194 which is produced by the same manufacturer as that of JASCO RS-207 is used.

(Method of mechanically removing oxide film)

Next, a method of mechanically shaving an oxide film of the seal rings 45 will be described. In an example of such a mechanical method, the oxide film is shaved off by rotating a metal brush. In this process, there may arise a case where rust preventing oil of the metal brush, a shaved-off oxide film of a high temperature, metal powder, and the like scatter, adhere to the glass tube 44 and are baken. In order to prevent such a case from occurring, it is preferable to conduct the process by spraying water to the glass tube 44.

[Shape of end portion of glass tube 44]

Figure 9:
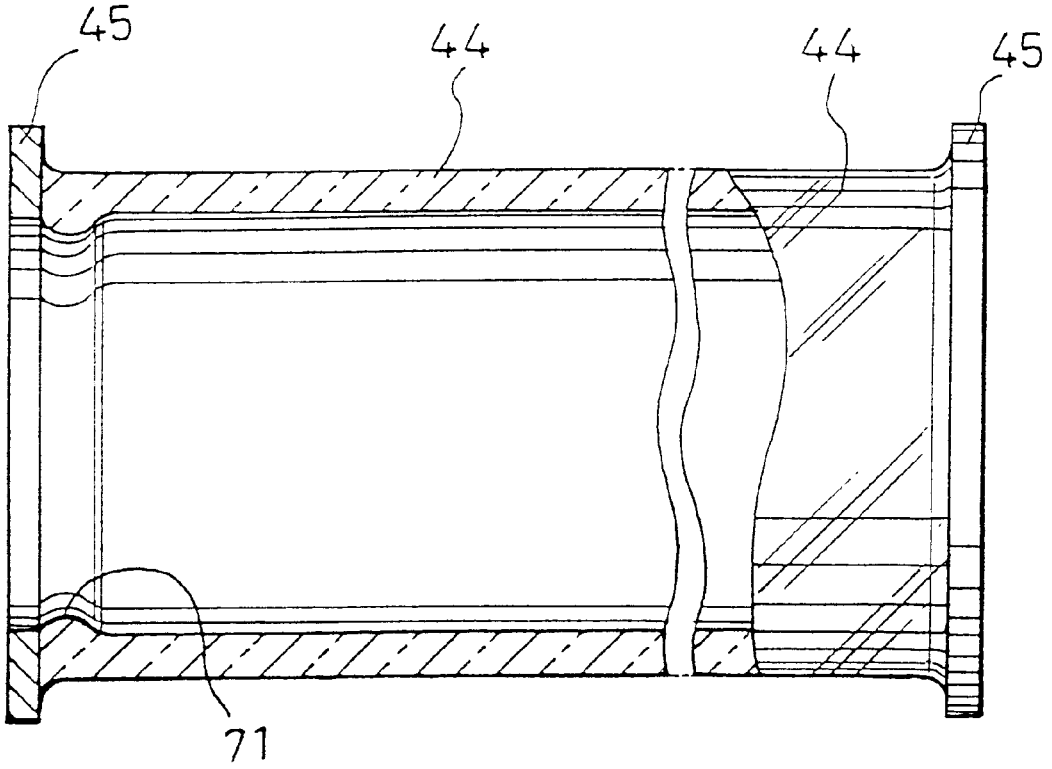
FIG. 9 is a partial section view showing an annular projection in a welding portion of a glass tube 44 and a metal part 45.

When the glass tube 44 and the seal ring 45 were welded together, the end portion of the glass tube 44 may be deformed and upheave as shown in FIG. 9 so as to form an annular projection 71. When the melting margin of the glass tube 44 is 0.2 to 0.3 mm, the annular projection 71 is formed. In the case that the annular projection 71 is formed, when the high-resistor paste is applied in a later step, the thickness of the applied layer of the high-resistor paste is reduced on the portion of the annular projection 71 and a conduction failure is liable to occur. The annular projection 71 can be removed away by mechanically shaving off after the welding process. However, this process is cumbersome. In order to prevent an annular projection from being formed, therefore, the glass tube 44 and the seal rings 45 are configured as shown below.

Figure 10:
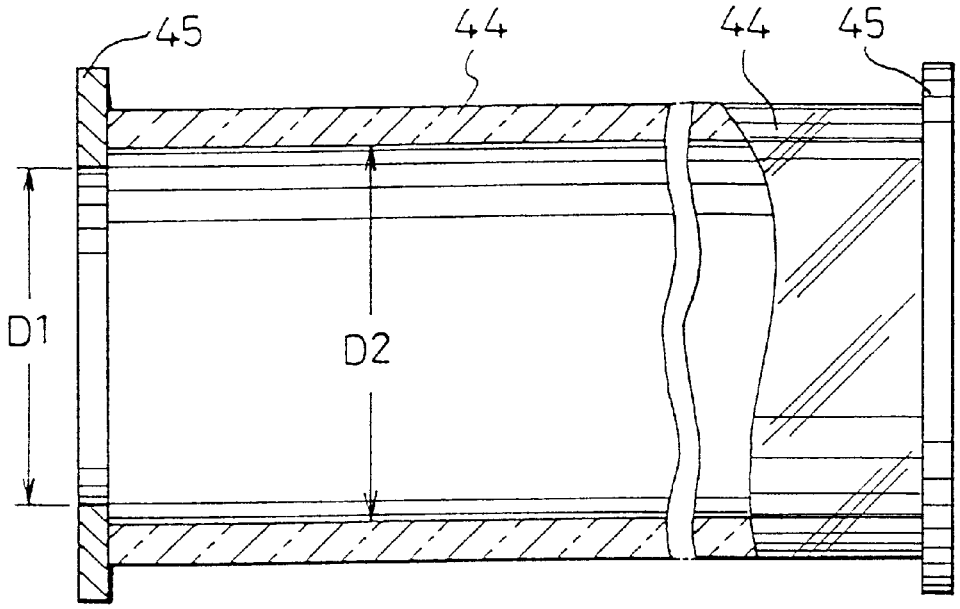
FIG. 10(*a*) is a partial section view showing relationships between inner diameters of a metal part and a glass tube in Embodiment 2.
Figure 10:
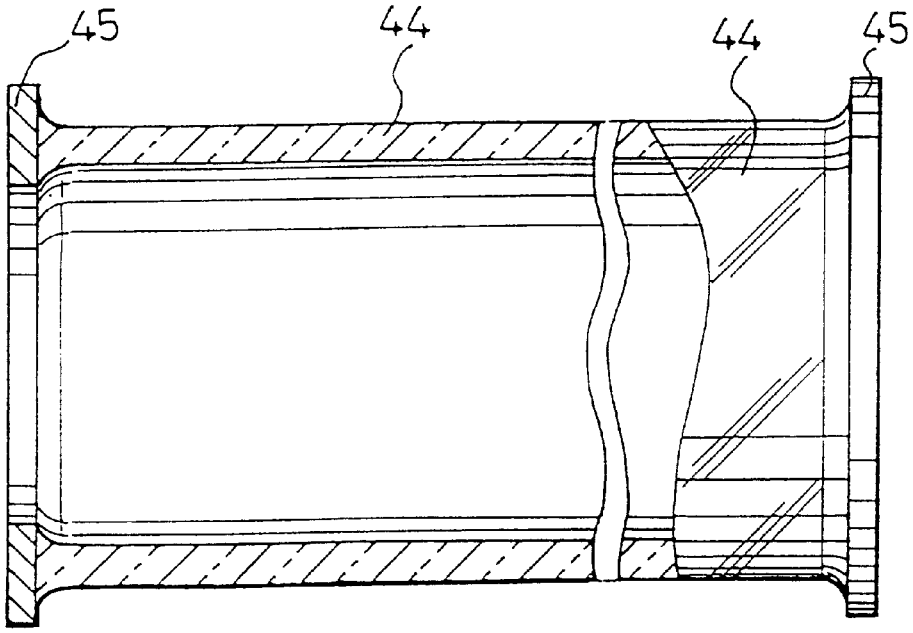

FIG. 10(*a*) is a section view of the glass tube 44 and the seal ring 45 which shows a first configuration. In the figure, the inner diameter of the seal ring 45 is made smaller than the inner diameter of the glass tube 44. When the glass tube 44 and the seal ring 45 which are thus configured are welded together, the end portion of the glass tube 44 has a smooth flare shape and an annular projection is not formed as shown in FIG. 10(*b*). When the difference between the inner diameters of the seal ring 45 and the glass tube 44 is appropriately set, a desired flare shape can be formed.

Figure 11:
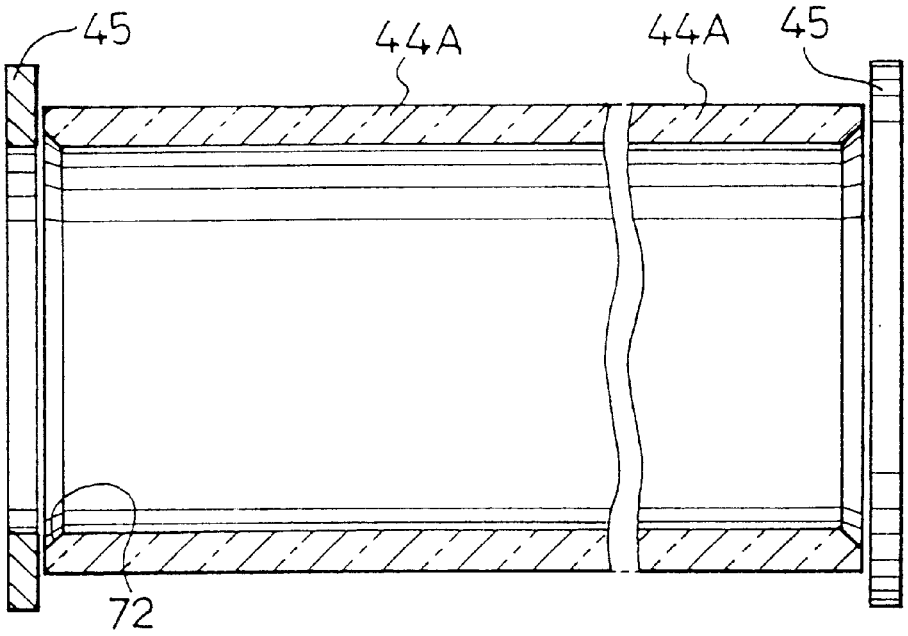
FIG. 11(*a*) is a partial section view showing a metal part and a glass tube in which an edge portion is chamfered.
Figure 11:
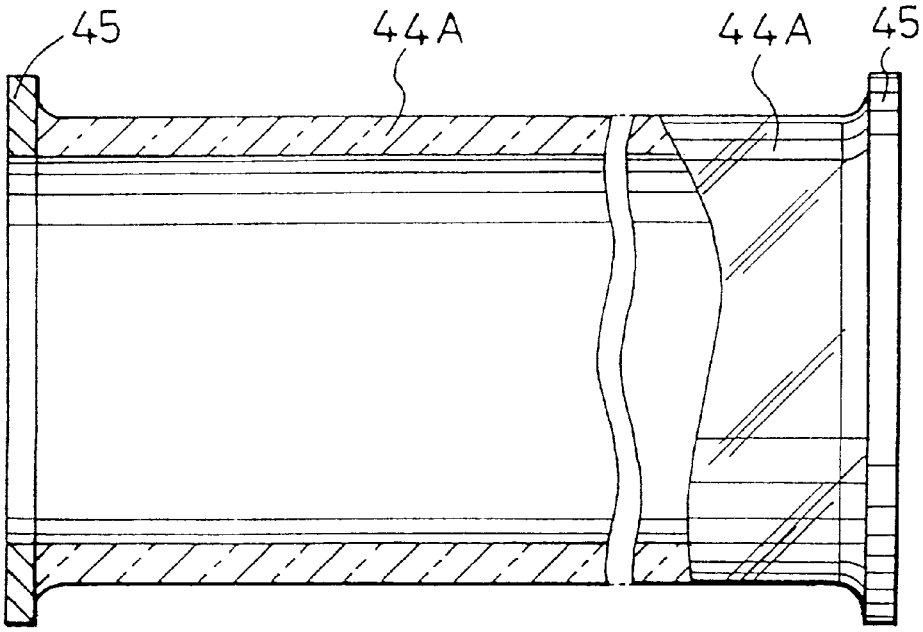

FIG. 11(*a*) is a section view of the glass tube 44 and the seal ring 45 which shows a second configuration. In the figure, the inner diameter of the seal ring 45 is substantially equal to the inner diameter of the glass tube 44. The inner face of the end portion of the glass tube 44 is chamfered so as to form a chamfered portion 72. For example, the size of chamfering is 0.2 to 0.5 mm. When the glass tube 44 which is thus configured is welded, the inner diameter of the glass tube 44 becomes substantially equal to the inner diameter of the seal ring 45 and an annular projection is not formed as shown in FIG. 11(*b*).

Industrial Applicability

The method of producing a cathode ray tube of the invention comprises the steps of: applying a high-resistor paste on the inner face of a glass tube for the main focusing lens and then drying the paste, thereby forming a high-resistor film; forming a spiral groove in the above-mentioned high-resistor film; and firing the above-mentioned high-resistor film at 420 to 550 deg. C. As the above-mentioned high-resistor paste, what provides the above-mentioned spiral high-resistor with a resistance that is not lower than 0.8 GΩ and not higher than 100 GΩ by firing in the above-mentioned temperature range is used. According to this matter, it is not required to use expensive ceramic or quartz glass as the material of the glass tube for the main focusing lens, and usual inexpensive glass can be used.

A high-resistance suspension containing a mixture of ruthenium hydroxide and glass powder which is problematic in the prior art is not used, and a high-resistor material in which ruthenium oxide is added to glass powder is used as a high-resistor paste, whereby the temperature dependency of the resistance of the spiral high-resistor 23 can be reduced.

Since glass powder having a softening point which is lower than the annealing point of the glass tube is used, the firing temperature is lowered, so that an inexpensive glass tube can be used. Furthermore, the firing at a low temperature causes distortion of the glass tube to be eliminated and can prevent the glass tube from being deformed.

Since the thermal expansion coefficients of the glass tube, the frit material, the seal ring, and the high-resistor material which constitute the electron gun 2 are made coincident with each other, it is possible to prevent a crack and separation from occurring in the high-resistor film, and also to prevent the seal ring from being separated from the glass tube.

Since the spiral high-resistor is provided with a resistance that is not lower than 0.8 GΩ and not higher than 100 GΩ, a potential distribution suitable for an electron beam is obtained by a voltage applied to the spiral high-resistor disposed on the inner face of the glass tube.

In the main focusing lens using the high-resistor, since the potential gradient forming an electron lens is gentle and uniform, an effect in which the lens diameter of the main focusing lens is apparently increased is produced. As a result, the spherical aberration can be reduced and a high-resolution cathode ray tube can be realized.

Since an oxide film of the seal ring is removed, it is possible to realize a good connection state between the metal part and the high-resistor film.

Since the welding process is conducted in an inert gas atmosphere, the surface of the seal ring can be prevented from being oxidized. Since an oxide film is removed, moreover, it is possible to prevent a connection failure between the seal ring and the high-resistor film from occurring when the high-resistor film is formed.

Since the inner diameter of the seal ring is made smaller than the inner diameter of the glass tube, it is possible to prevent an annular projection from being formed during the welding process. Since the inner face of the end portion of the glass tube is chamfered, moreover, it is similarly possible to prevent the annular projection from being formed.

Although the invention has been described in its preferred forms with a certain degree of particularity, it is understood that the present disclosure of the preferred forms should be changed in the details of construction, and variations of the combination and arrangement of elements may be realized without departing from the spirit and the scope of the invention as claimed.

We claim:

1. A method of producing a cathode ray tube having a spiral high-resistor formed on an inner face of a glass tube which functions as a main focusing lens for an electron gun, wherein the method of producing the cathode ray tube comprises the steps of:

applying a high-resistor paste on the inner face of the glass tube, thereby forming a high-resistor film;

forming a spiral groove in said high-resistor film; and firing said high-resistor film having said spiral groove at a temperature in the range of 440 to 460 deg. C. to obtain the spiral high-resistor, whereby the spiral high-resistor has a resistance value that is not lower than 0.8 GΩ and not higher than 100 GΩ as a result of the firing in said temperature range.

2. A method of producing a cathode ray tube according to claim 1, wherein the high-resistor paste comprises ruthenium oxide added to glass powder, the glass powder having a softening temperature that is lower than an annealing temperature of the glass tube.

3. A method of producing a cathode ray tube according to claim 2, wherein said glass powder contains about 77 wt. % of PbO, about 18 wt. % of $B_2O_3$, and about 5 wt. % of $SiO_2$, and the ruthenium oxide of said high-resistor paste is in the range of 0.5 to 5 wt. %.

4. A method of producing a cathode ray tube according to claim 1, wherein the thermal expansion coefficient of the glass tube and the high-resistor material is in the range of 85 to $105\times10^{-7}$/deg. C.

5. A method of producing a cathode ray tube according to claim 1, wherein the resistance of said spiral high-resistor is set so that, when a difference voltage between an anode voltage and a focus voltage is applied to said spiral high-resistor, a current flowing through said spiral high-resistor is in the range of 0.25 μA to 30 μA.

6. A cathode ray tube having a spiral high-resistor formed on an inner face of a glass tube having a seal ring, and serving as a main focusing lens for an electron gun, wherein the cathode ray tube comprises:

a high-resistor paste for forming said spiral high-resistor, the paste comprising ruthenium oxide and glass powder, the glass powder having a softening temperature that is lower than an annealing temperature of said glass tube.

7. A cathode ray tube according to claim 6, wherein the thermal expansion coefficients of the glass tube, the seal ring, and the high-resistance material which constitute the electron gun are in the range of 85 to $105\times10^{-7}$/deg. C.

8. A cathode ray tube according to claim 6, wherein the resistance of said spiral high-resistor is selected so that, when a difference voltage between an anode voltage and a focus voltage is applied to said spiral high-resistor, a current flowing through said spiral high-resistor is in the range of 0.25 μA to 30 μA.

9. A method of producing a cathode ray tube, the tube having a main focusing lens in which a high-resistor is formed into a spiral shape by a high-resistance material having a thermal expansion coefficient of 36 to $105\times10^{-7}$/deg. C., on an inner face of a glass tube having a tubular structure made of borosilicate glass or soda glass material having a thermal expansion coefficient of 36 to $105\times10^{-7}$/deg. C. and a volume resistance of $1\times10^{10}$ to $1\times10^{12}$ ohm·cm, comprising the steps of:

disposing metal terminals to both ends of said glass tube, respectively, said metal terminals providing for electrical connection with electrodes of an electron gun;

applying a high-resistor paste to said glass tube, thereby forming a high-resistor film;

forming said high-resistor film into a spiral structure;

firing said glass tube at a temperature in the range of 420 to 550 deg. C.; and connecting said metal terminals of the glass tube to electrodes whereby the electron gun is formed.

10. A method of producing a cathode ray tube according to claim 9, further comprising the step of disposing a focusing voltage supply portion in the vicinity of the center of said glass tube.

11. A method of producing a cathode ray tube according to claim 9, wherein the high-resistor paste is comprised of ruthenium oxide added to a glass material having a softening temperature that is lower than an annealing temperature of said glass tube.

12. A method of producing a cathode ray tube according to claim 9, wherein the resistance of the spiral high-resistor is set so that, when a difference voltage between an anode voltage and a focus voltage is applied to said spiral high-resistor, a current flowing through said spiral high resistor is in the range of 0.25 $\mu$A to 30 $\mu$A.

13. A method of producing a cathode ray tube according to claim 11, wherein said glass material contains in the range of 25 to 40 wt. % of a filler material comprising at least one of $ZrO_2$, $SiO_2$, and $A1_2O_3$.

14. A method of producing a cathode ray tube having a spiral high-resistor formed on an inner face of a glass tube, the spiral high-resistor functioning as a main focusing lens for an electron gun, wherein the method of producing the cathode ray tube comprises the steps of:

bonding a metal terminal to said glass tube, melting a frit, wherein the thermal expansion coefficients of said glass tube, said frit, said metal, terminal and a material of said spiral high-resistor is in the range of 36 to $105\times10^{-7}$/deg. C.

15. A method of producing a cathode ray tube having a spiral high-resistor formed on an inner face of a glass tube, which functions as a main focusing lens for an electron gun, wherein, the method of producing the cathode ray tube comprises the steps of:

welding said glass tube to a metal terminal by melting a frit or said glass tube itself, in order to bond the metal terminal to said glass tube, said glass tube and said metal part being conducted in a reducing gas atmosphere or an inert gas atmosphere.

16. A method of producing a cathode ray tube having a spiral high-resistor formed on an inner face of a glass tube which functions as a main focusing lens for an electron gun, wherein, the method of producing the cathode ray tube comprises the steps of:

welding said glass tube to a metal terminal by melting a frit or said glass tube itself, in order to bond the metal terminal to said glass tube, the metal terminal having a film for preventing oxidation on said metal terminal.

17. A method of producing a cathode ray tube according to claim 16, wherein said film for preventing oxidation is a film which is formed by one of deposition of gold, gold plating, chrome plating, and nickel plating.

18. A method of producing a cathode ray tube having a spiral high-resistor formed on an inner face of a glass tube which functions as a main focusing lens for an electron gun, the method of producing the cathode ray tube comprising the steps of:

welding said glass tube to the metal terminal by melting a frit or said glass tube itself; and removing an oxide film on a surface of said metal terminal after welding said glass tube to said metal terminal whereby the metal terminal electrically connects to the spiral high-resistor for connection as the focusing lens of the electron gun.

19. A method of producing a cathode ray tube according to claim 18, wherein said step of removing the oxide film is a reduction step by means of heating in a hydrogen or hydrogen-mixture gas atmosphere.

20. A method of producing a cathode ray tube according to claim 19, wherein the hydrogen or hydrogen-mixture gas atmosphere is formed by passing hydrogen or a hydrogen-mixture gas through a straightening mesh.

21. A method of producing a cathode ray tube according to claim 19, wherein the hydrogen or hydrogen mixture gas atmosphere prevents entrance of oxygen from occurring by burning hydrogen.

22. A method of producing a cathode ray tube according to claim 18, wherein said step of removing the oxide film comprises the step of immersing said metal terminal in hydrochloric acid or a hydrochloric acid rust removing agent.

23. A method of producing a cathode ray tube according to claim 22, wherein said step of removing the oxide film further comprises the step of, after immersing said metal terminal in hydrochloric acid or a hydrochloric acid rust removing agent, immersing said metal terminal in a neutralizing rust preventing agent.

24. A method of producing a cathode ray tube according to claim 18, wherein said step of removing the oxide film comprises the step of mechanically shaving off the oxide film.

25. A method of producing a cathode ray tube having a spiral high-resistor formed on an inner face of a glass tube which functions as a main focusing lens for an electron gun, wherein the method of producing the cathode ray tube comprises the steps of:

welding said glass tube to a metal terminal by melting a frit or said glass tube itself, the metal terminal applying a predetermined potential to said spiral high-resistor; and flattening the bonded portion of said metal terminal and said glass tube.

26. A method of producing a cathode ray tube having a spiral high-resistor formed on an inner face of a glass tube which functions as a main focusing lens for an electron gun, wherein the method of producing the cathode ray tube comprises the steps of:

welding at least one open end of said glass tube to a metal terminal by melting said glass tube itself, the metal terminal for applying a predetermined potential to said spiral high-resistor; and chamfering an inner face in the vicinity of said open end of said glass tube.

27. A method of producing a cathode ray tube having a spiral high-resistor formed on an inner face of a glass tube which functions as a main focusing lens for an electron gun, wherein the method of producing the cathode ray tube comprises the steps of:

welding at least one open end of said glass tube to a metal terminal by melting said glass tube itself, the metal terminal for applying a predetermined potential to said spiral high-resistor; and making an inner diameter of said glass tube larger than an inner diameter of said metal part.

28. A cathode ray tube having a main focusing lens in which a high-resistor is formed into a spiral shape by a high-resistance material having a thermal expansion coefficient of 36 to $105\times10^{-7}$/deg. C., on an inner face of a glass tube having a tubular structure made of borosilicate glass or soda glass material having a thermal expansion coefficient of 36 to $105\times10^{-7}$/deg. C. and a volume resistance of $1\times10^{10}$ to $1\times10^{12}$ ohm·cm, further comprising:

metal terminals which are used for electrical connection disposed at both ends of said glass tube;

a high-resistor film which is obtained by forming a high-resistor paste into a spiral shape on an inner face of said glass tube and firing at a temperature in the range of 420 to 550 deg. C.; and electrodes of an electron gun attached to said glass tube whereby the high-resistor serves as the focusing lens of the cathode ray tube.

29. A cathode ray tube according to claim 28 characterized in that said cathode ray tube further comprises a focusing voltage supply portion which is disposed in the vicinity of the center of said glass tube.

30. A cathode ray tube having a spiral high-resistor which functions as a main focusing lens for an electron gun and which is formed on an inner face of a glass tube, the cathode ray tube comprising:

a metal terminal which is bonded to said glass tube by melting a frit and which applies a predetermined potential to said spiral high-resistor, the thermal expansion coefficients of said glass tube, said frit, said metal terminal, and a material of said spiral high-resistor being in the range of 36 x to $105\times10^{-7}$/deg. C.

31. A cathode ray tube having a spiral high-resistor formed on an inner face of a glass tube which functions as a main focusing lens for an electron gun, wherein the cathode ray tube comprising:

a metal terminal which is welded to said glass tube by melting a frit or said glass tube itself, the welding of said glass tube and said metal terminal being conducted in a reducing gas atmosphere or an inert gas atmosphere, the metal terminal applying a predetermined potential to said spiral high-resistor.

32. A cathode ray tube having a spiral high-resistor formed on an inner face of a glass tube to function as a main focusing lens for an electron gun, the cathode ray tube comprising:

a metal terminal having a film for preventing oxidation on said metal terminal which is welded to said glass tube by melting a frit or said glass tube itself, the metal terminal provided to apply a predetermined potential to said spiral high-resistor.

33. A cathode ray tube according to claim 32 wherein said film for preventing oxidation is formed by one of deposition of gold, gold plating, chromium plating, and nickel plating.

34. A cathode ray tube having a spiral high-resistor formed on an inner face of a glass tube which functions as a main focusing lens for an electron gun, the cathode ray tube comprising:

a metal terminal which is welded to said glass tube by melting a frit or said glass tube itself the metal terminal applying a predetermined potential to said spiral high-resistor, the metal terminal having an oxide film on a surface of said metal terminal, after welding said glass tube to said metal terminal.

35. A cathode ray tube according to claim 34 wherein the removal of said oxide film is conducted by reduction in a hydrogen or hydrogen-mixture gas atmosphere.

36. A cathode ray tube having a spiral high-resistor formed on an inner face of a glass tube, to function as a main focusing lens for an electron gun, the cathode ray tube comprising:

a metal terminal which is welded to said glass tube by melting a frit or said glass tube itself the metal terminal applying a predetermined potential to said spiral high-resistor, the portion of said glass tube which is welded to the metal terminal being flattened.

37. A cathode ray tube having a spiral high-resistor formed on an inner face of a glass tube, to function as a main focusing lens for an electron gun, the cathode ray tube comprising:

a metal terminal which is welded to at least one open end of said glass tube by melting said glass tube itself, the metal terminal applying a predetermined potential to said spiral high-resistor, the inner face of the tube in the vicinity of said open end being chamfered.

38. A cathode ray tube having a spiral high-resistor formed on an inner face of a glass tube, to function as a main focusing lens for an electron gun, the cathode ray tube having a metal terminal which is welded to at least one open end of said glass tube by melting said glass tube itself, the metal terminal providing electrical connection to the spiral high-resistor for applying a predetermined potential to said spiral high-resistor, the inner diameter of said glass tube being larger than an inner diameter of said metal terminal.

* * * * *